US008516929B2

(12) United States Patent
Huang

(10) Patent No.: US 8,516,929 B2
(45) Date of Patent: Aug. 27, 2013

(54) OPEN-END WRENCH FOR QUICKLY TURNING AN OBJECT

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 205 days.

(21) Appl. No.: 13/093,966

(22) Filed: Apr. 26, 2011

(65) Prior Publication Data

US 2012/0272794 A1 Nov. 1, 2012

(51) Int. Cl.
*B25B 13/28* (2006.01)

(52) U.S. Cl.
USPC ..... 81/90.1; 81/186

(58) Field of Classification Search
USPC ..... 81/90.1, 92, 97–99, 103, 111–116, 81/183, 186, 58.2
See application file for complete search history.

(56) References Cited

U.S. PATENT DOCUMENTS

| | | | | | |
|---|---|---|---|---|---|
| 1,322,643 | A * | 11/1919 | Steen | 81/97 |
| 1,661,229 | A * | 3/1928 | Montgomery | 81/92 |
| 2,659,257 | A * | 11/1953 | Thompson | 81/90.1 |
| 2,700,315 | A * | 1/1955 | Hermanson | 81/183 |
| 3,906,822 | A * | 9/1975 | Hertelendy et al. | 81/90.1 |
| 8,261,640 | B2 * | 9/2012 | Wu | 81/186 |
| 2003/0154830 | A1 * | 8/2003 | Wu | 81/186 |

FOREIGN PATENT DOCUMENTS

| | | |
|---|---|---|
| TW | M384740 U1 | 7/2010 |
| TW | M392040 U1 | 11/2010 |

* cited by examiner

*Primary Examiner* — David B Thomas
(74) *Attorney, Agent, or Firm* — Alan Kamrath; Kamrath IP Lawfirm, P.A.

(57) ABSTRACT

An open-end wrench for quickly turning an object includes a driving end including a first jaw and a second jaw which cooperate together. One of the first and second jaws includes a recess defined therein. Further, a movable engaging member includes a body pivotally fixed in the recess by a pivot. The body is in a surface contact with a lateral wall of the recess, and the recess supports the body. The pivot is inserted through the body and is fixedly engaged with a wall of the recess. Further, an elastic member resiliently engages with the movable engaging member. Furthermore, the open-end wrench is turned in a first turning direction to turn the object and in a second turning direction to move relatively to the object.

13 Claims, 25 Drawing Sheets

OPEN-END WRENCH FOR QUICKLY TURNING AN OBJECT

BACKGROUND OF THE INVENTION

1. Field of the Invention

The present invention relates to a wrench and, particularly, to a wrench with a driving end which is open-ended. An object can be turned quickly with the open-end wrench. The open-end wrench is turned in one direction to turn the object and in another direction to turn relatively to the object.

2. Description of the Related Art

TW Pats. No. M384740 and M392040 show a wrench including a driving end which is open-ended. An object can be turned quickly with these wrenches, because when they are turned in one direction to turn the object, they are adapted to turn in another direction to move relatively to the object to a position that allows a better turning position for the user, which was done conventionally by disengaging the wrench with the object and then reengaging it.

TW Pat. No. M384740 shows its driving end including two jaws and a space defined between the jaws. An object is disposed in the space and clamped by the jaws when in engagement with the wrench. The driving end further includes a movable engaging member pivotally fixed and disposed in a recess defined in each jaw. The movable engaging member is fixedly engaged with the object when the wrench is turned in one direction with the object and is urged to move pivotally by the object when the wrench is turned in another direction to turn relatively to the object. Further, a spring is used to bias one movable engaging member. Furthermore, the movable engaging member engages with the object by an engaging end abutting against the object and is pivotally attached in the recess by attaching a connecting end to a bottom wall of the recess. The connecting end and the engaging end are formed as one piece. Therefore, the connecting end is not fixed as the movable engaging member is pivoted. Moreover, each movable engaging member is not supported by a lateral wall of the recess. While the movable engaging member is adapted to be pivoted without moving against the lateral wall of the recess and since friction does not exist between the movable engaging member and the recess, a large stress concentration exists on the connecting end of the movable engaging member.

TW Pat. No. M392040 shows its driving end with two jaws, with one of the jaws including a movable engaging member and a fixed member disposed in a recess defined in the jaw. The movable engaging member is biased by a spring that is supported by the fixed member and that is activated by the object engaged with the wrench. Furthermore, the movable engaging member is restrainedly moved in the recess by an axle that inserts therethrough and is fixed to the jaw. Therefore, the axle prevents the movable engaging member from disengagement from the recess.

It is still desirable to design an open-end wrench for quickly turning an object that includes a simple structure and has fewer parts than the conventional wrenches of this kind without compromising the use life of the parts. The parts are extended in life by increasing surface contacts and reducing stress concentrations therebetween.

The present invention is, therefore, intended to obviate or at least alleviate the problems encountered in the prior art.

SUMMARY OF THE INVENTION

According to the present invention, an open-end wrench for quickly turning an object includes a driving end including a first jaw and a second jaw which cooperate together to form a space defined therebetween. The object is received in the space and includes a circumferential surface abutting against the first and second jaws when it is to be operably turned by the open-end wrench. Furthermore, one of the first and second jaws includes a recess defined therein and having an opening connected to and communicating with the space. The open-end wrench further includes a movable engaging member including a body pivotally fixed in the recess by a pivot. The body is in a surface contact with a lateral wall of the recess, and the recess supports the body. The pivot is inserted in a direction through the body and is fixedly engaged with a wall of the recess. Further, an elastic member resiliently engages with the movable engaging member and includes a first leg abutting against the lateral wall of the recess and a second leg abutting against the movable engaging member.

Furthermore, the open-end wrench is turned in a first turning direction to turn the object, with the movable engaging member fixedly abutting against the circumferential surface of the object by the lateral wall of the recess. Moreover, the open-end wrench is turned in a second turning direction to move relatively to the object, with the object not turned, with the movable engaging member activated to pivot in a pivoting direction by the circumferential surface of the object, and with the engaging member activated to pivot in a reverse direction to the pivoting direction by the elastic member.

DETAILED DESCRIPTION OF THE PREFERRED EMBODIMENTS

Figure 1:
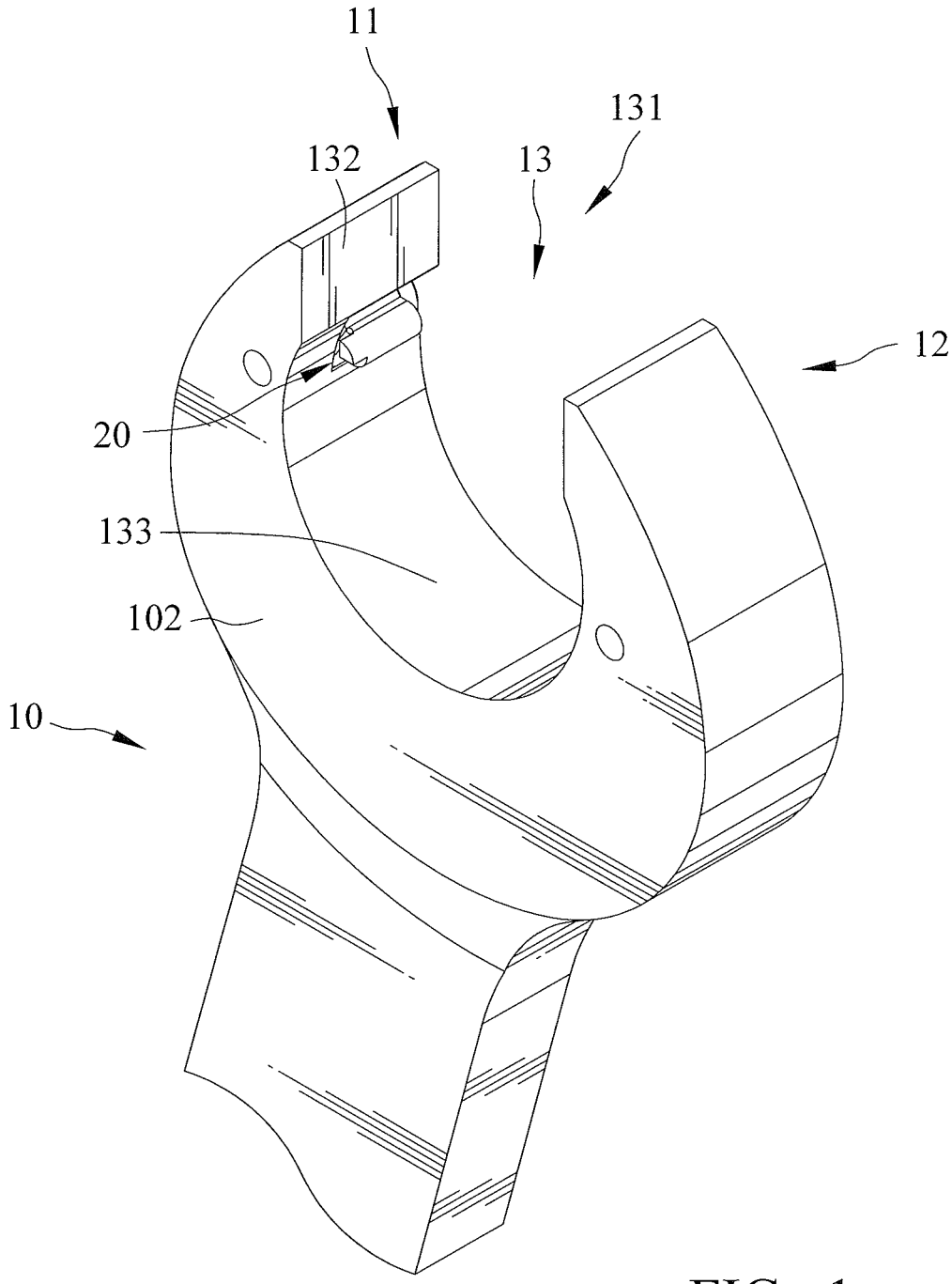
FIG. 1 is a perspective view of an open-end wrench for quickly turning an object in accordance with a first embodiment of the present invention.
Figure 2:
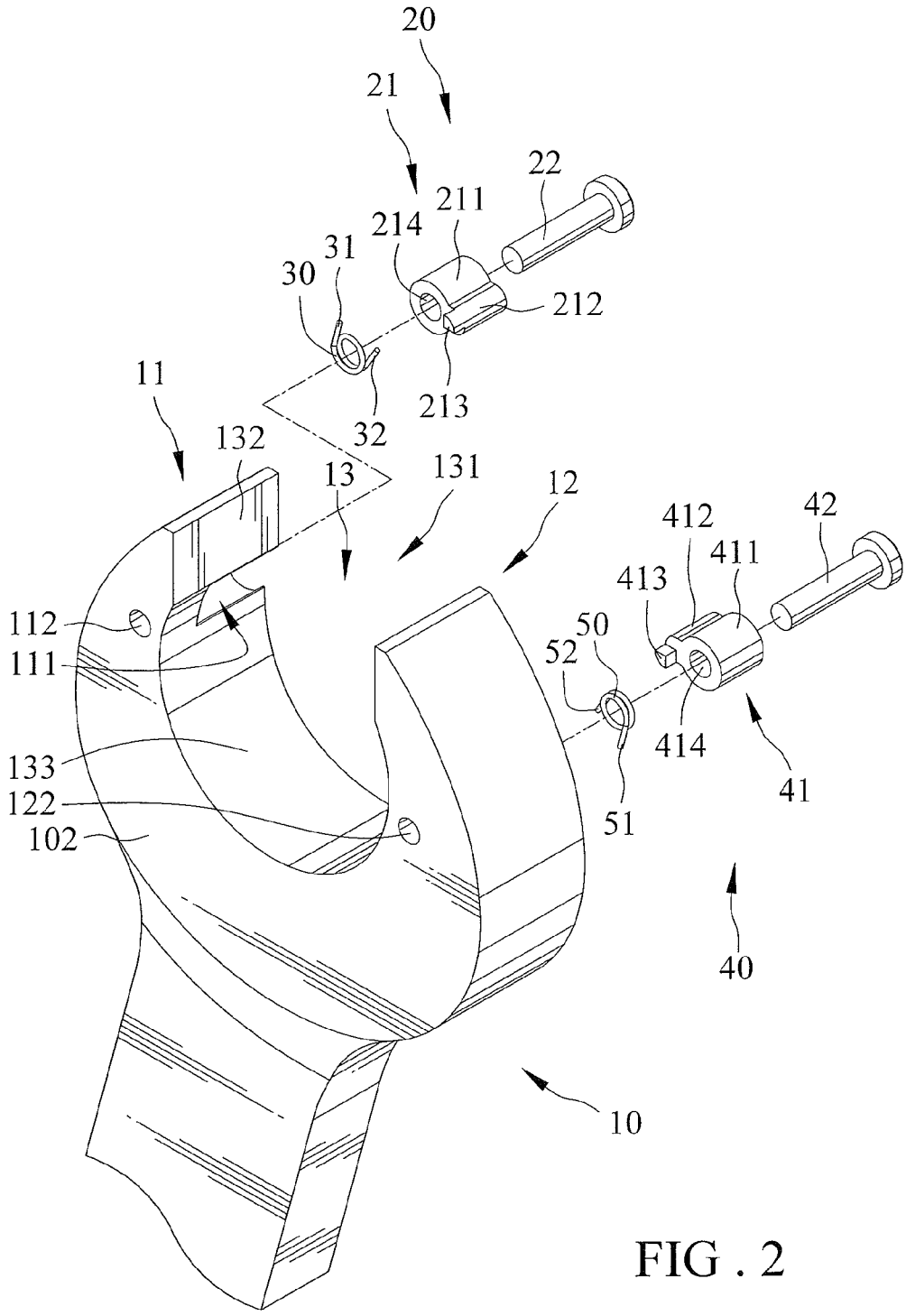
FIG. 2 is an exploded perspective view of the open-end wrench of FIG. 1.
Figure 3:
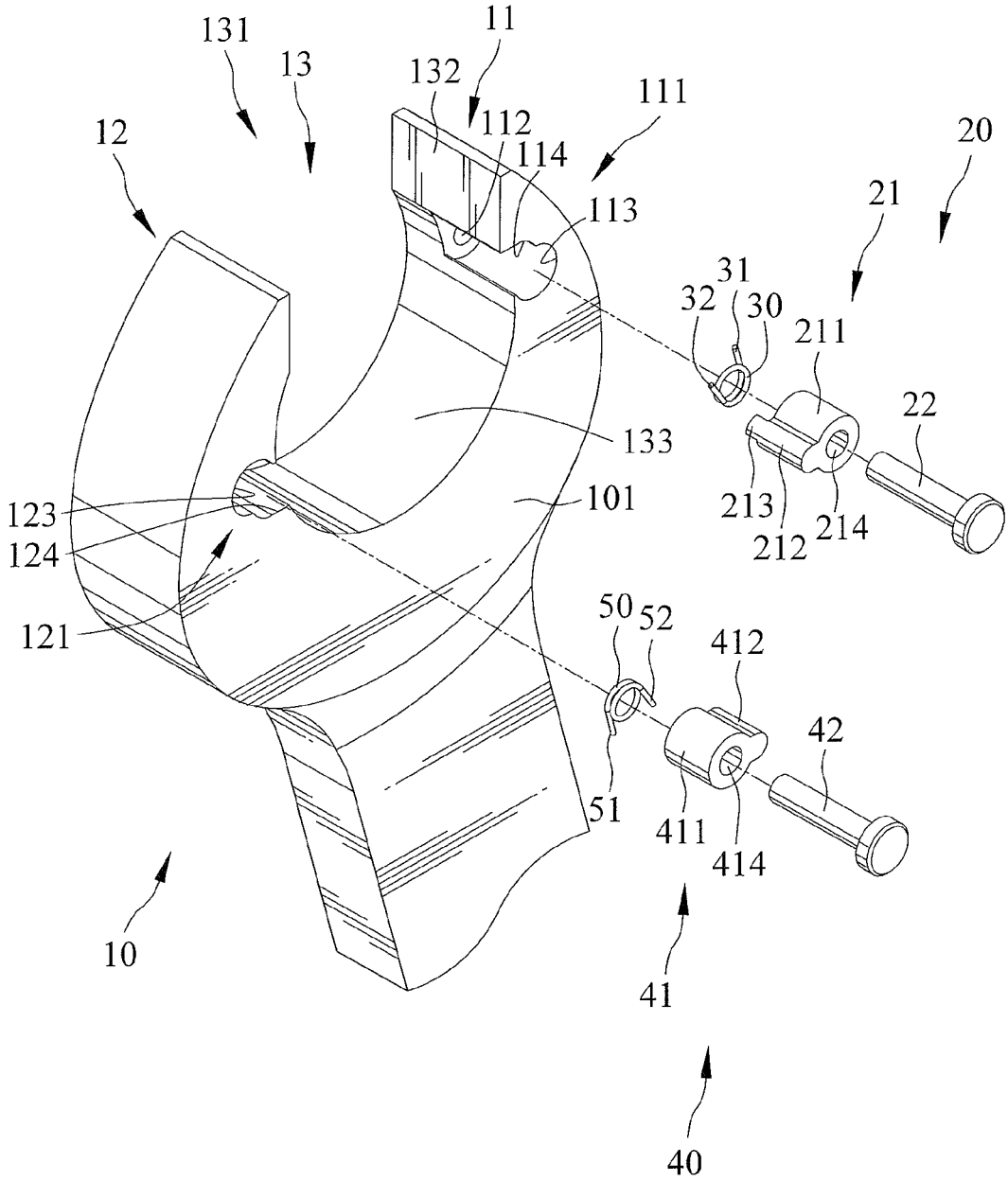
FIG. 3 is another exploded perspective view of the open-end wrench, taken from a view different than that of FIG. 2.
Figure 4:
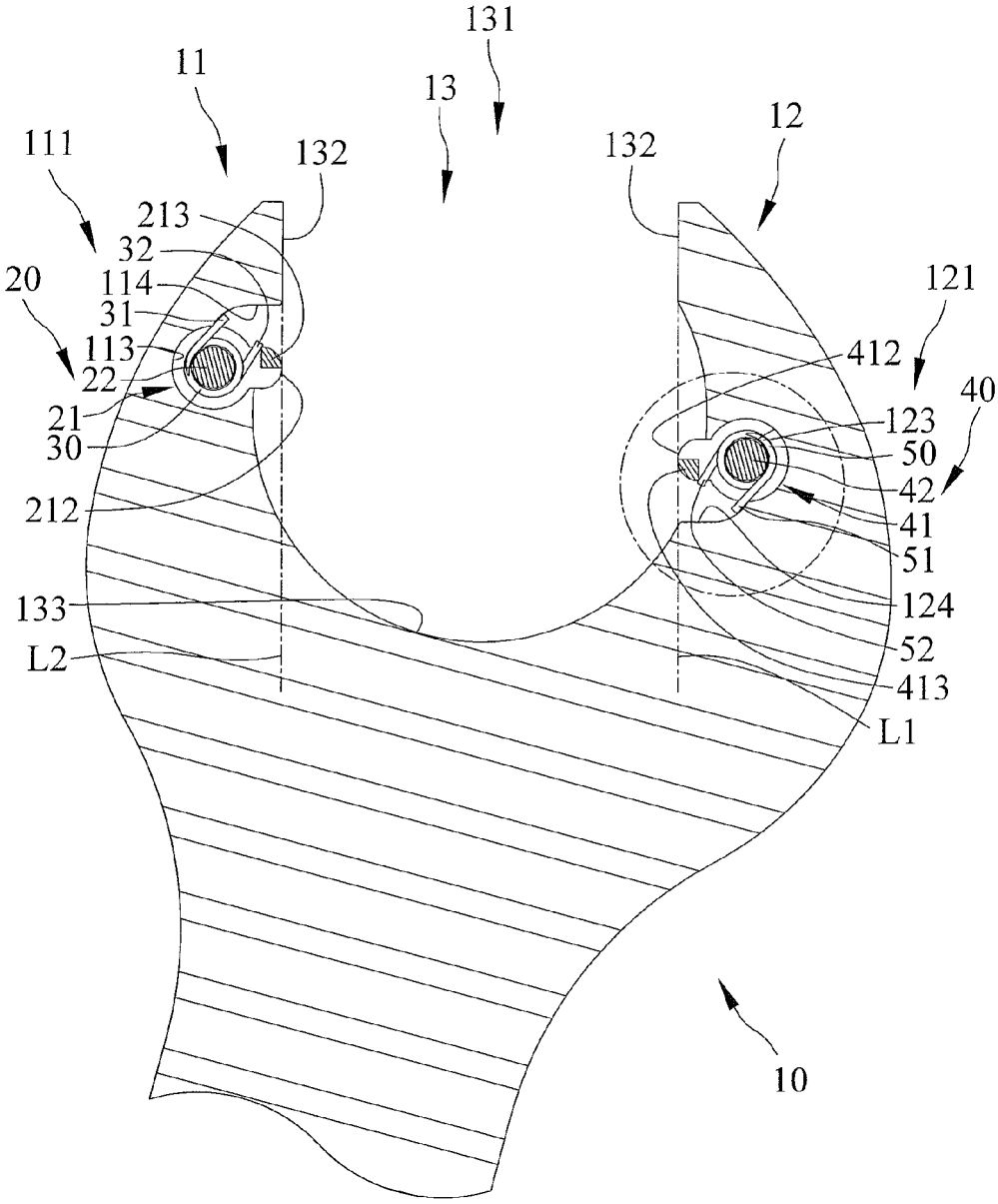
FIG. 4 is a cross-sectional view of the open-end wrench of FIG. 1.
Figure 5:
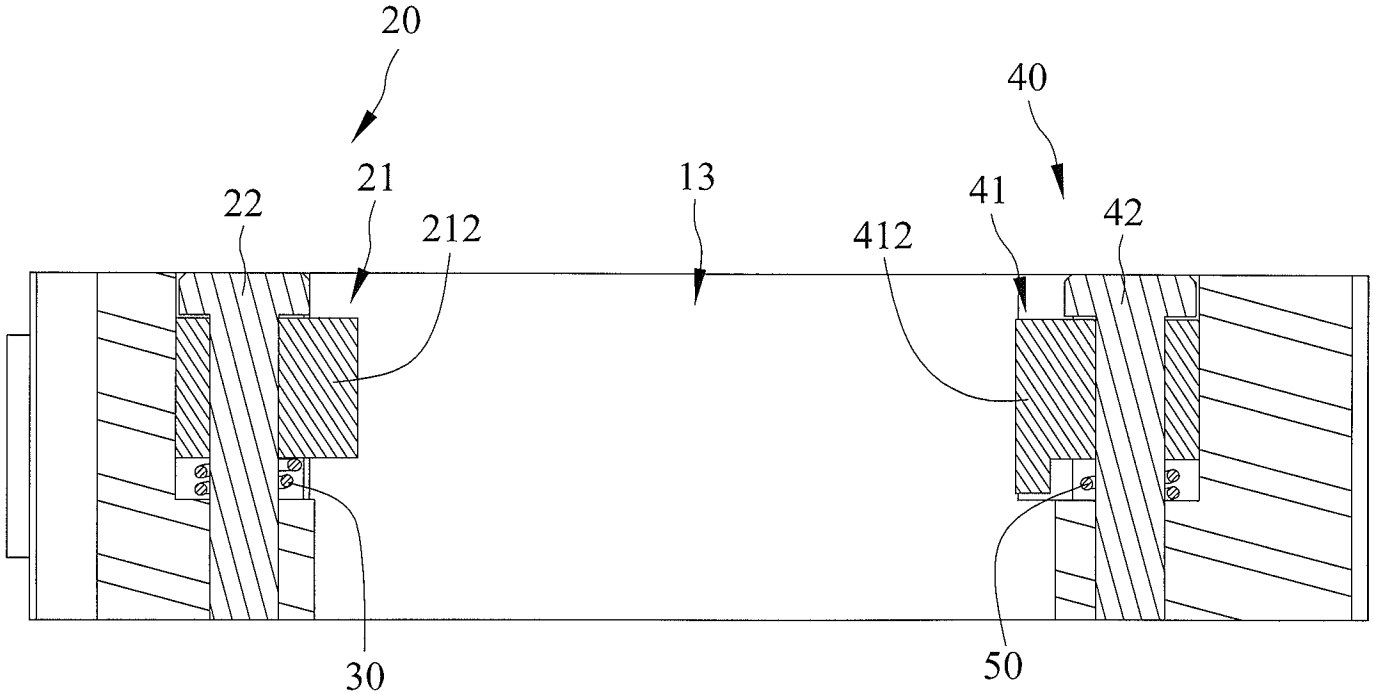
FIG. 5 is another cross-sectional view of the open-end wrench of FIG. 1.
Figure 6:
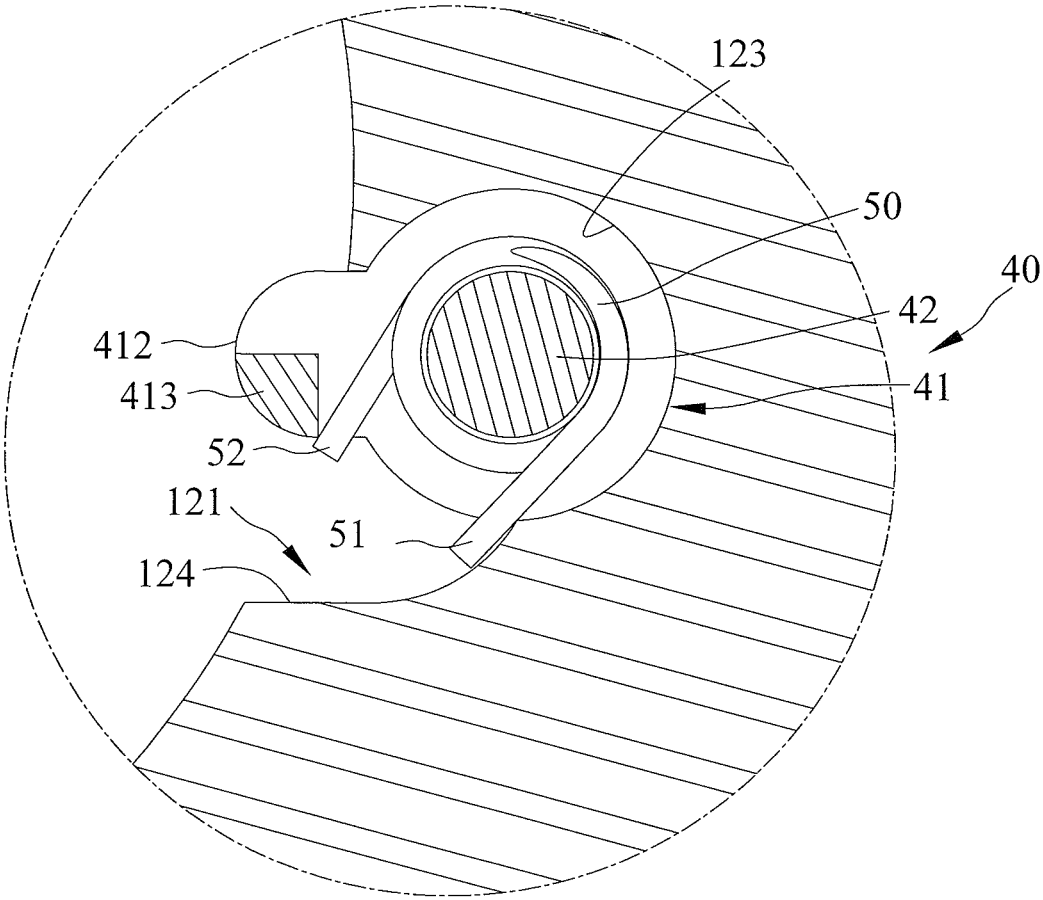
FIG. 6 is a partial, enlarged cross-sectional view of FIG. 4.
Figure 7:
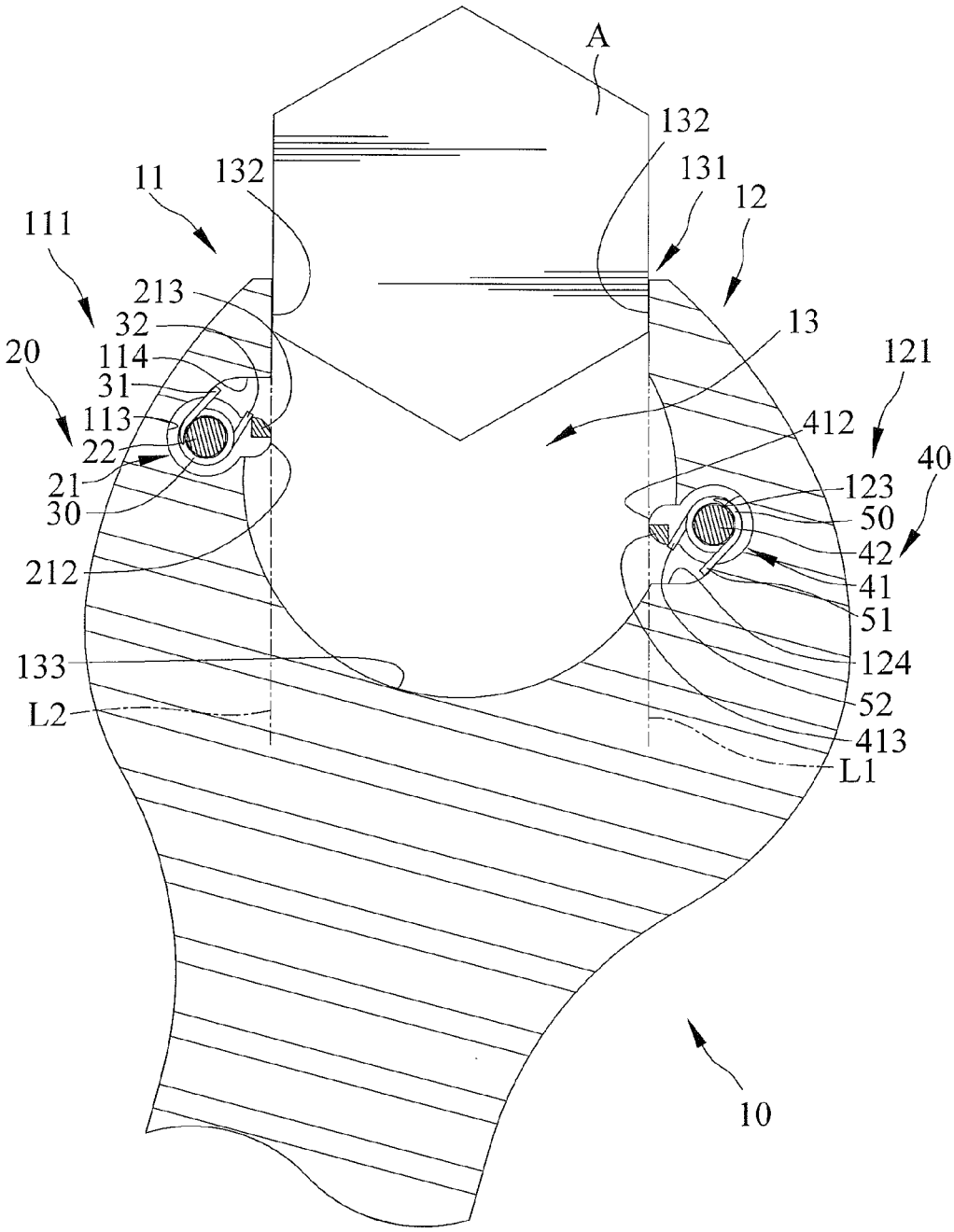
FIG. 7 is an extended cross-sectional view of FIG. 4 illustrating an object to be turned by the open-end wrench disposed between the tips of two jaws thereof.
Figure 8:
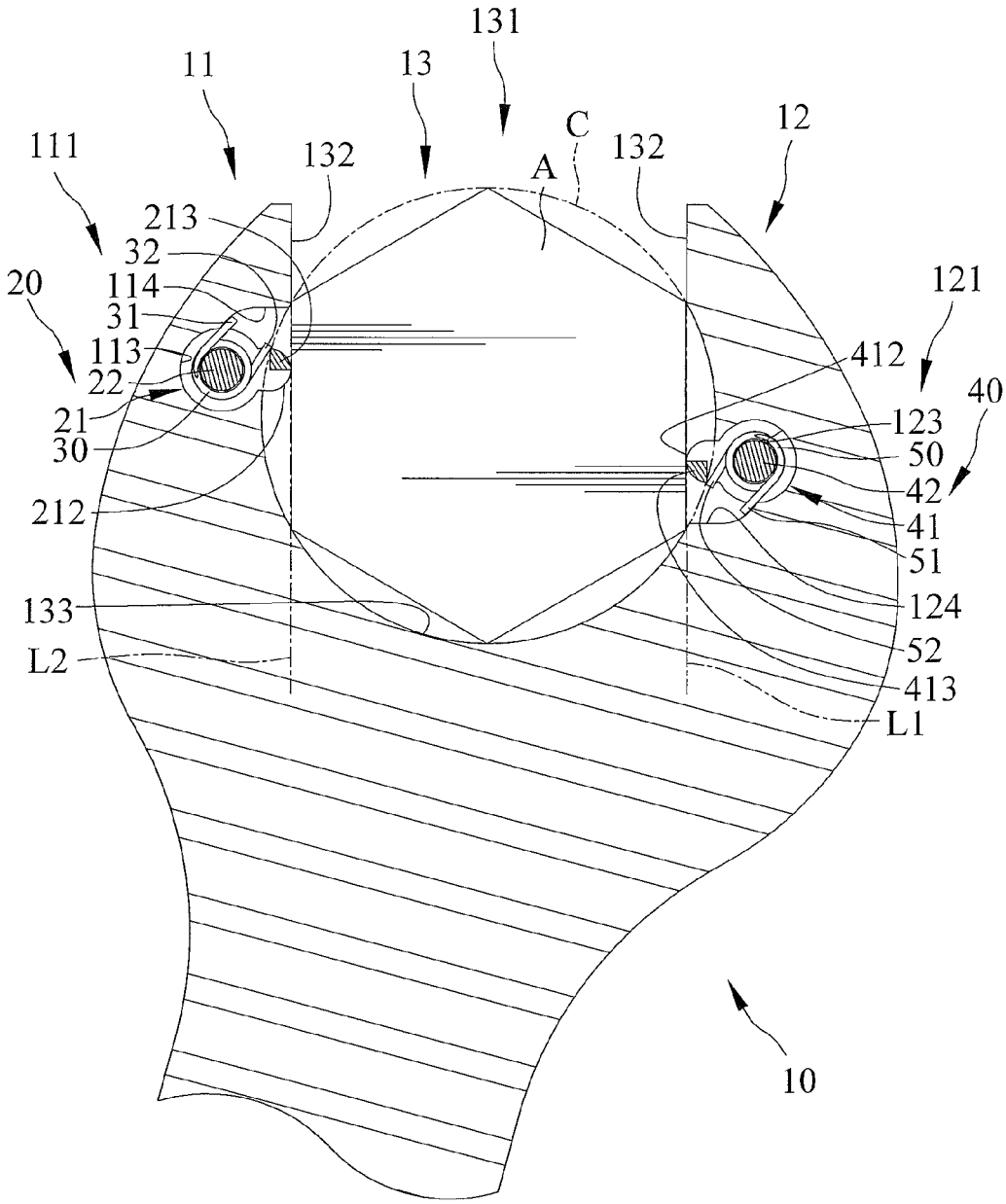
FIG. 8 is an extended cross-sectional view of FIG. 7 showing the object in an engaging position with the open-end wrench.
Figure 9:
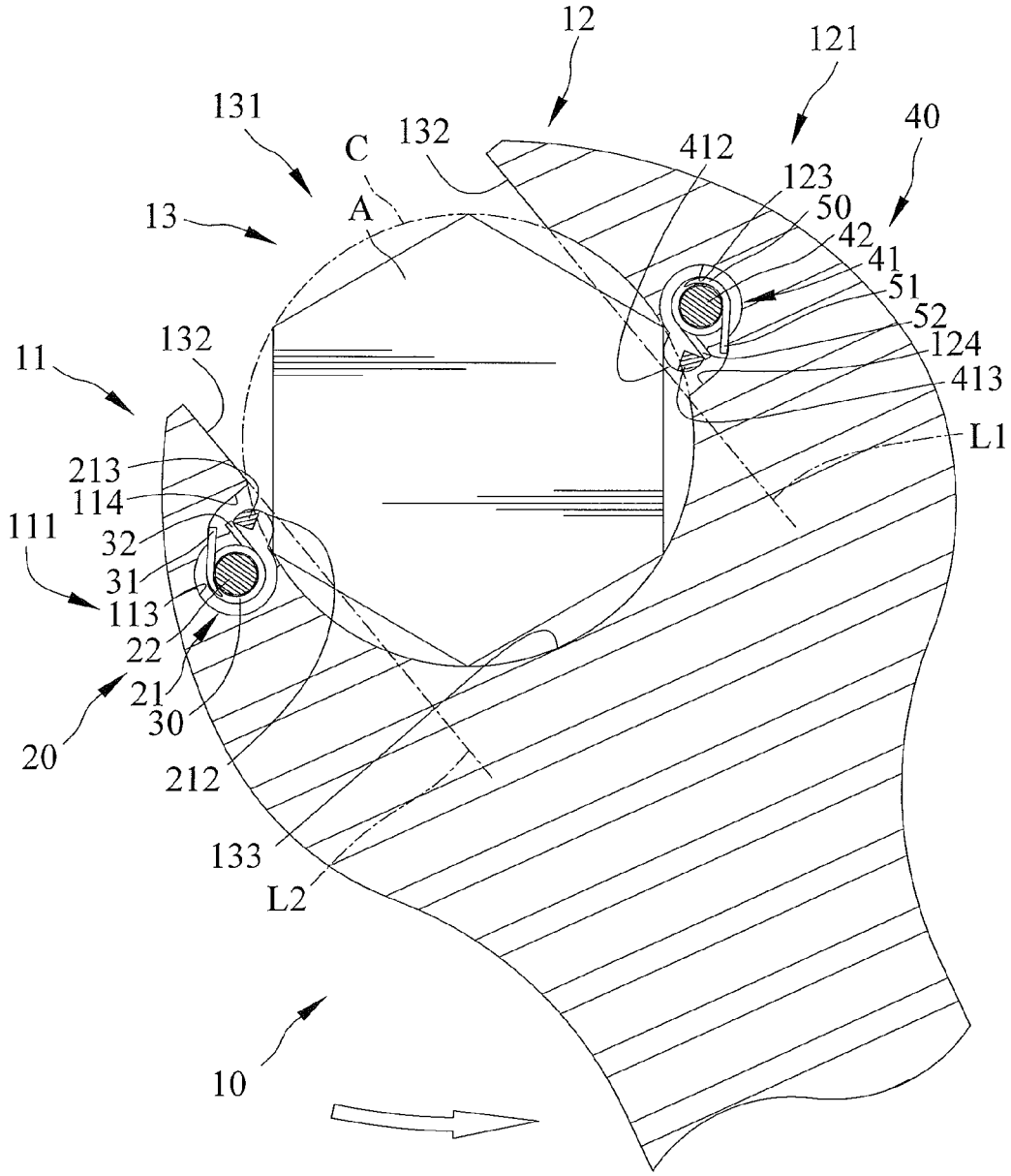
FIG. 9 is an extended cross-sectional view of FIG. 8 showing the open-end wrench turned in a direction where it is turned relatively to the object.
Figure 10:
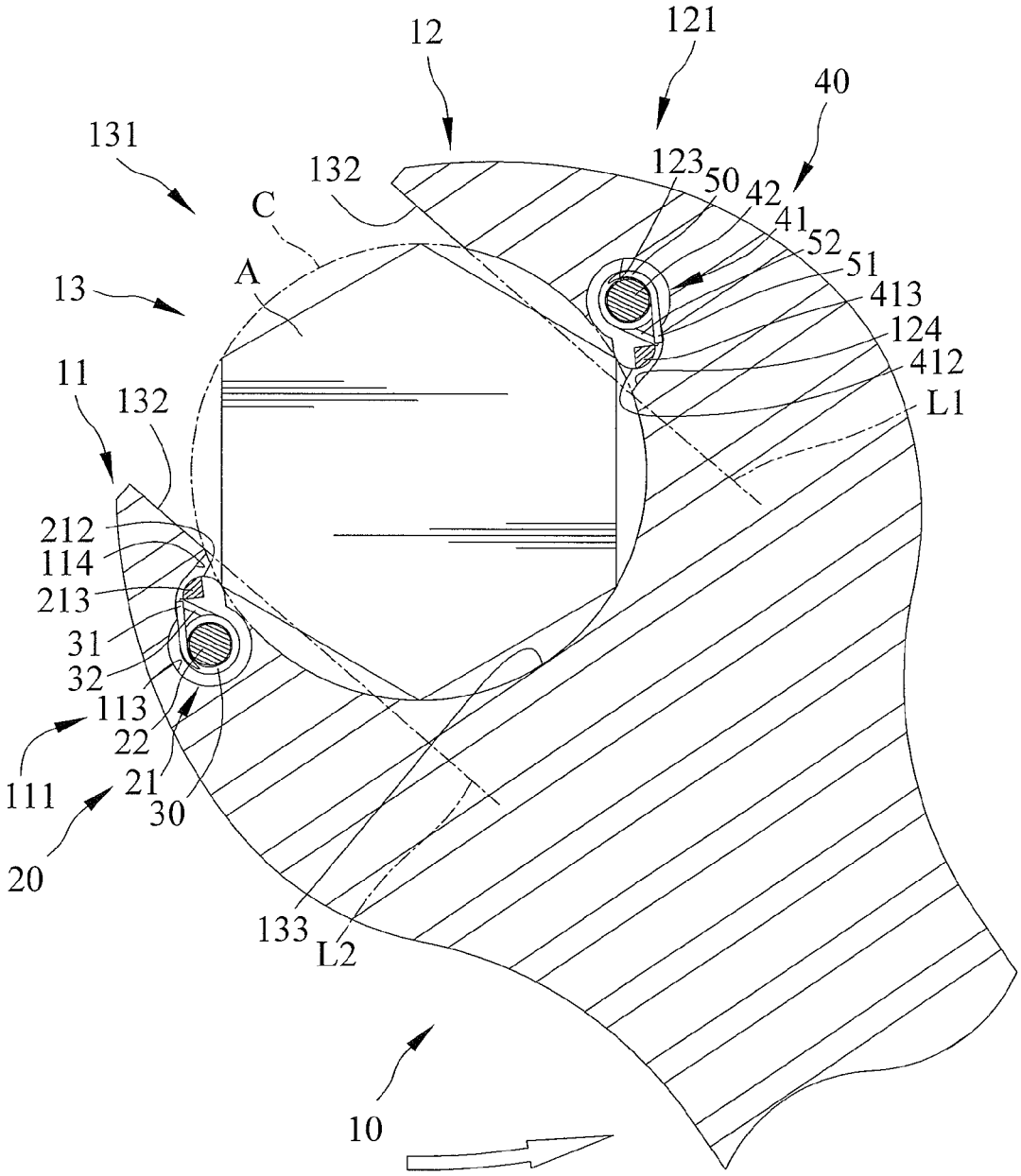
FIG. 10 is a continued cross-section view of FIG. 9.
Figure 11:
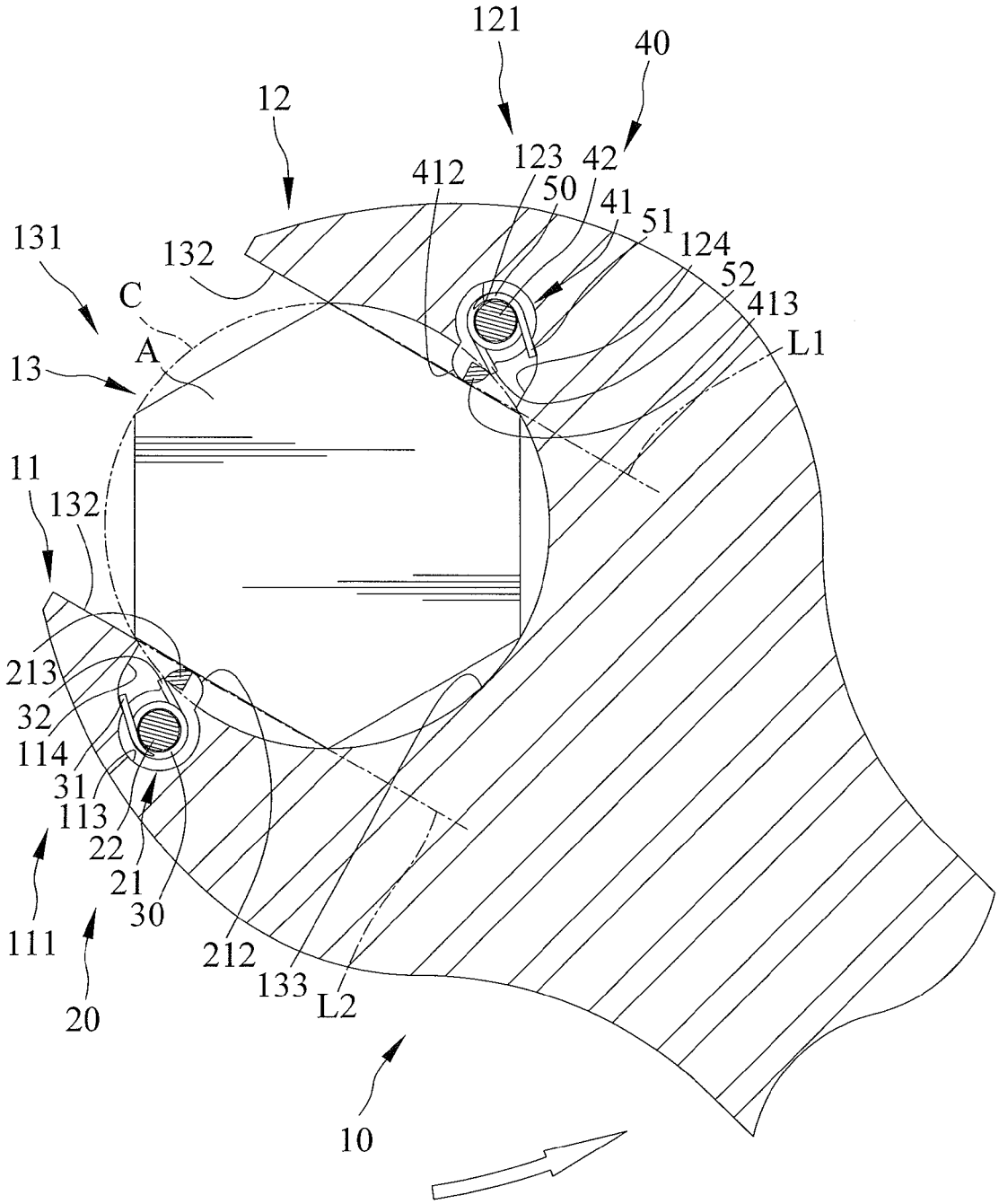
FIG. 11 is a continued cross-sectional view of FIG. 10.
Figure 12:
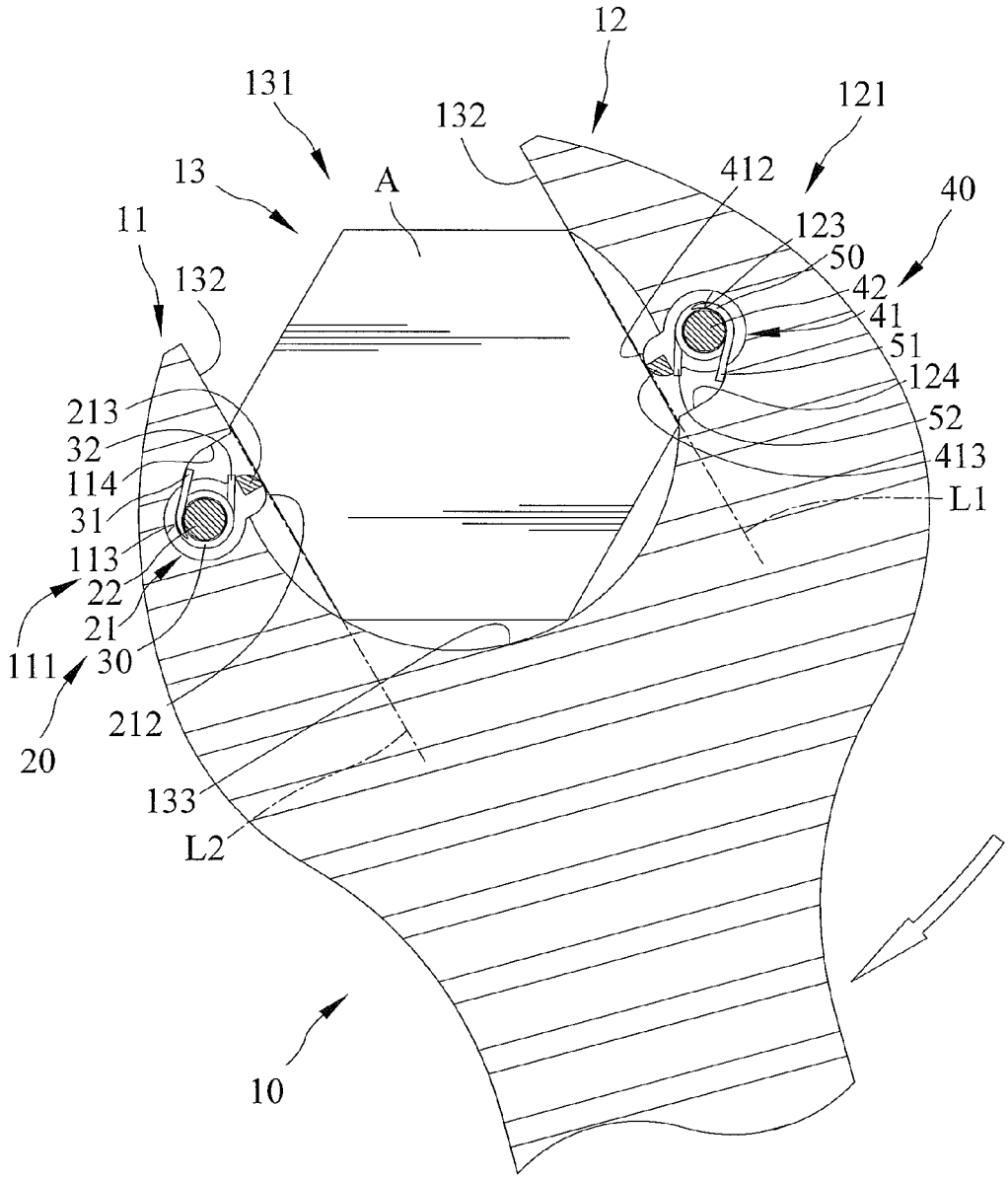
FIG. 12 is a cross-sectional view the showing the open-end wrench turned in a direction whereby the object is turned in the same direction.
Figure 13:
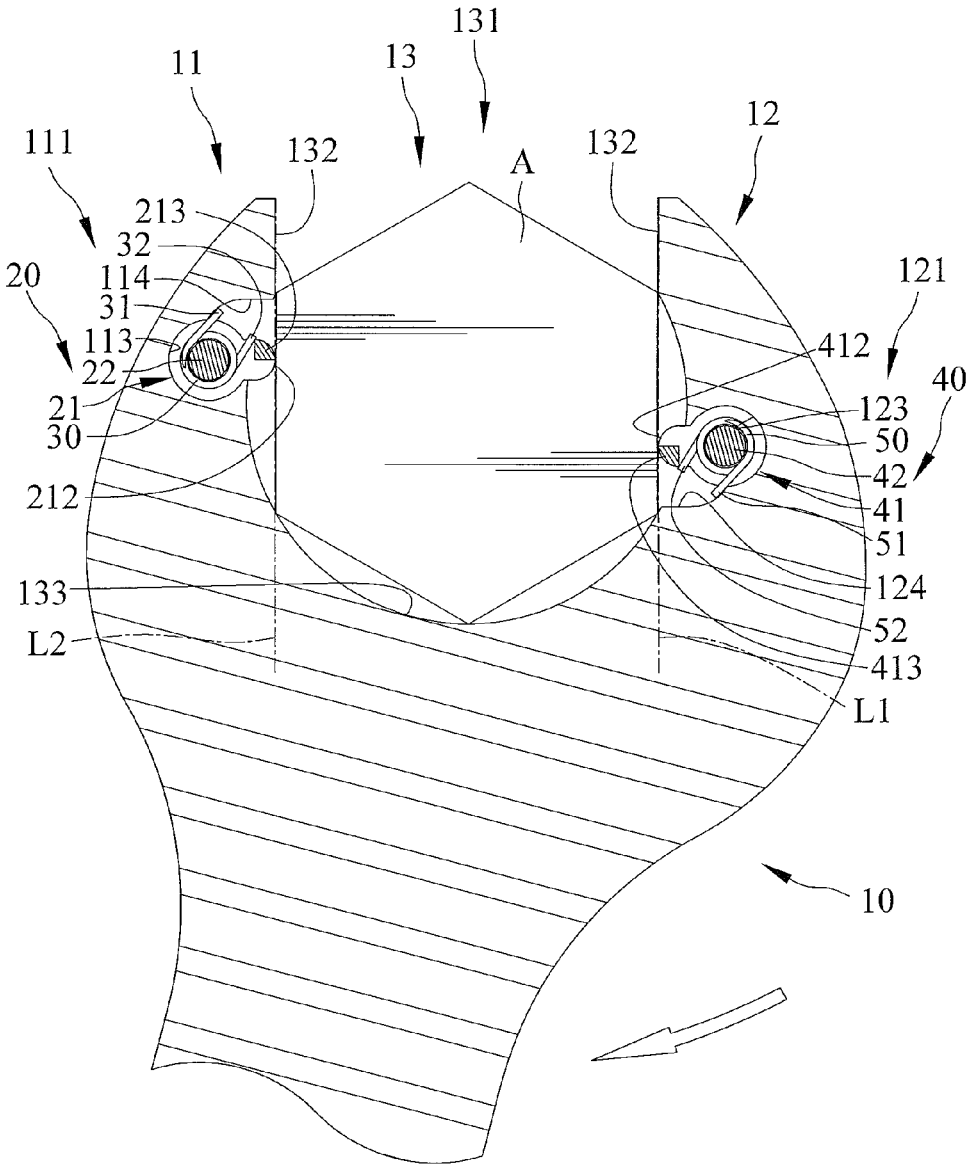
FIG. 13 is continued cross-section view of FIG. 12.
Figure 14:
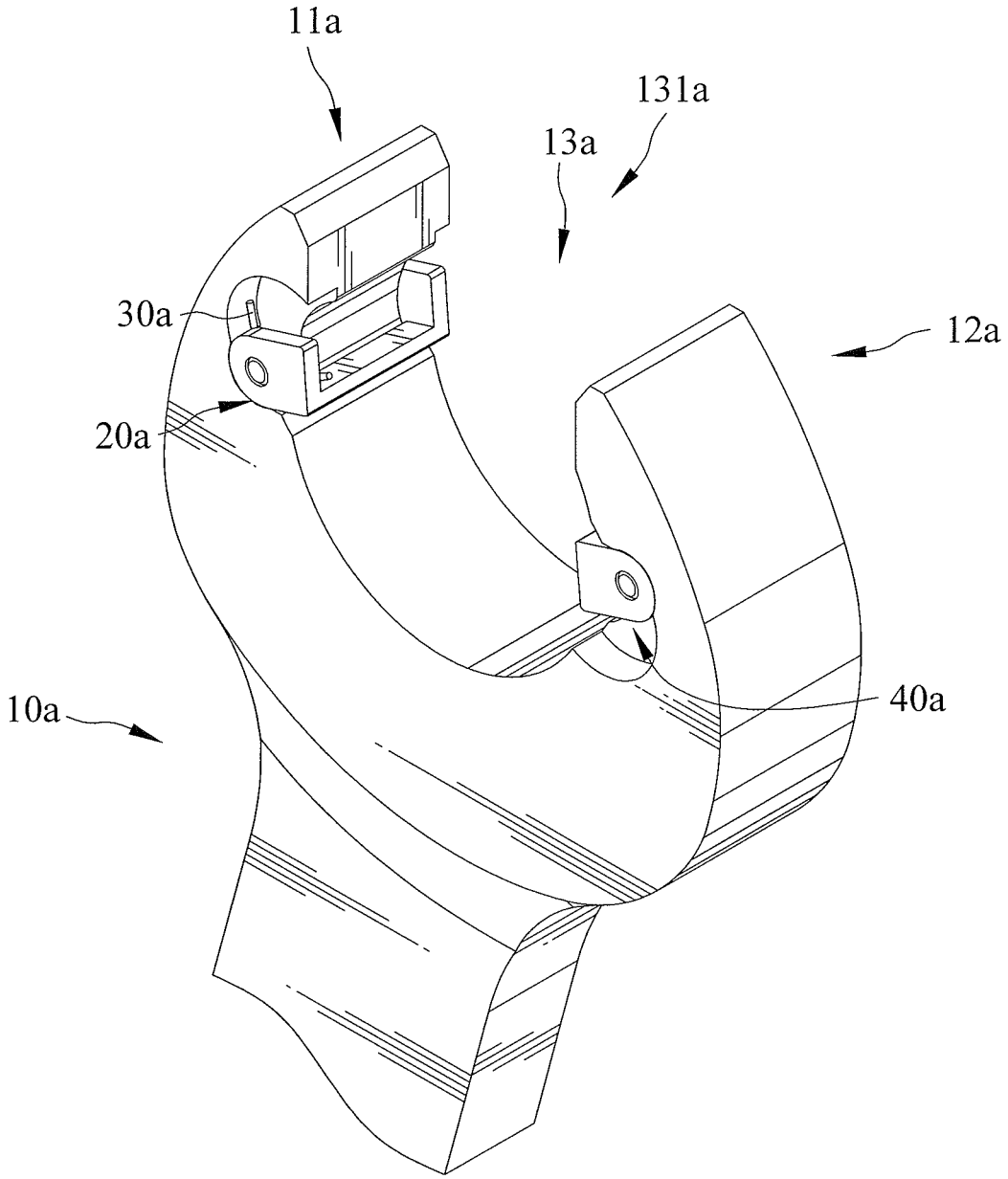
FIG. 14 is a perspective view of an open-end wrench for quickly turning an object in accordance with a second embodiment of the present invention.
Figure 15:
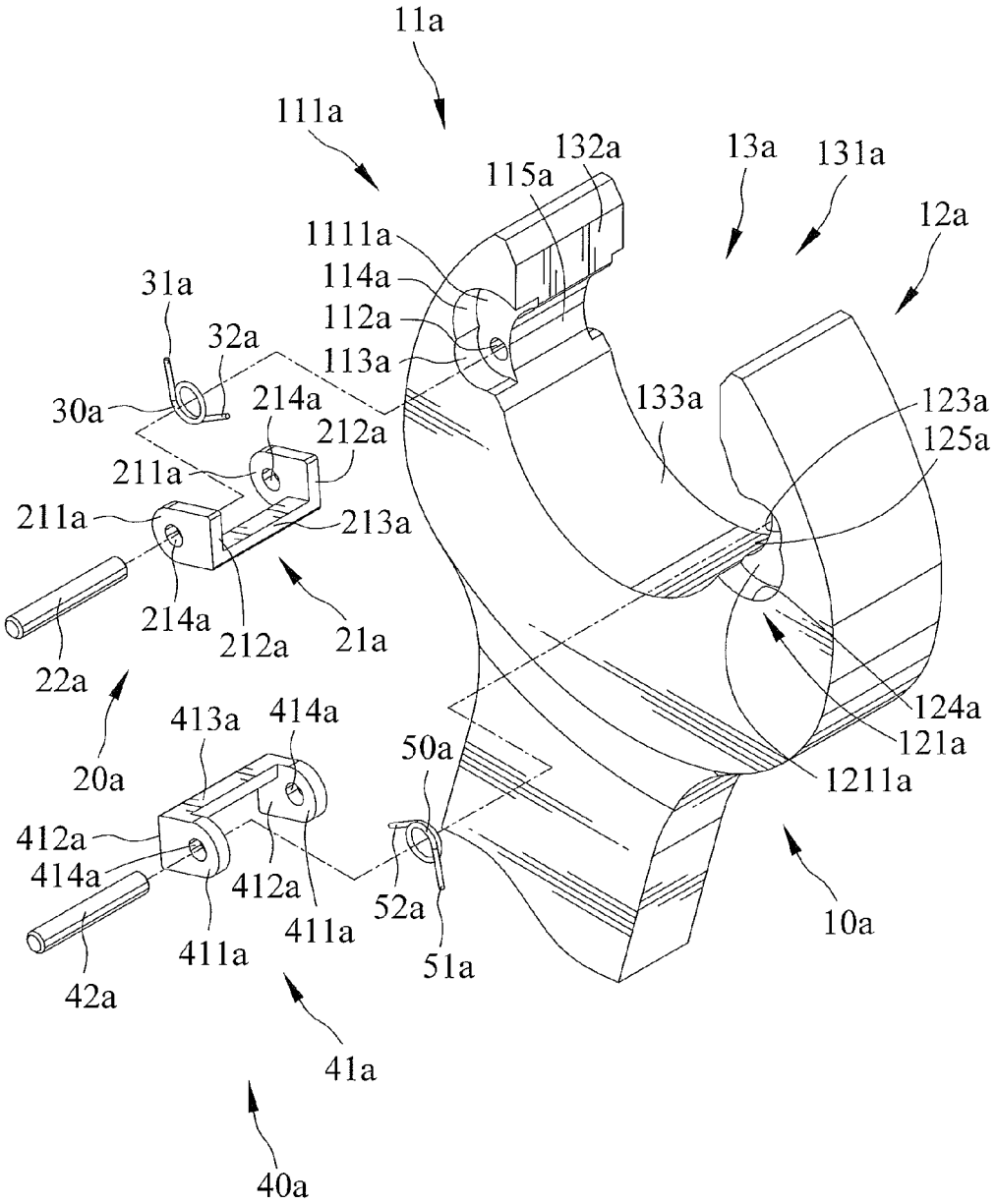
FIG. 15 is an exploded perspective view of the open-end wrench of FIG. 14.
Figure 16:
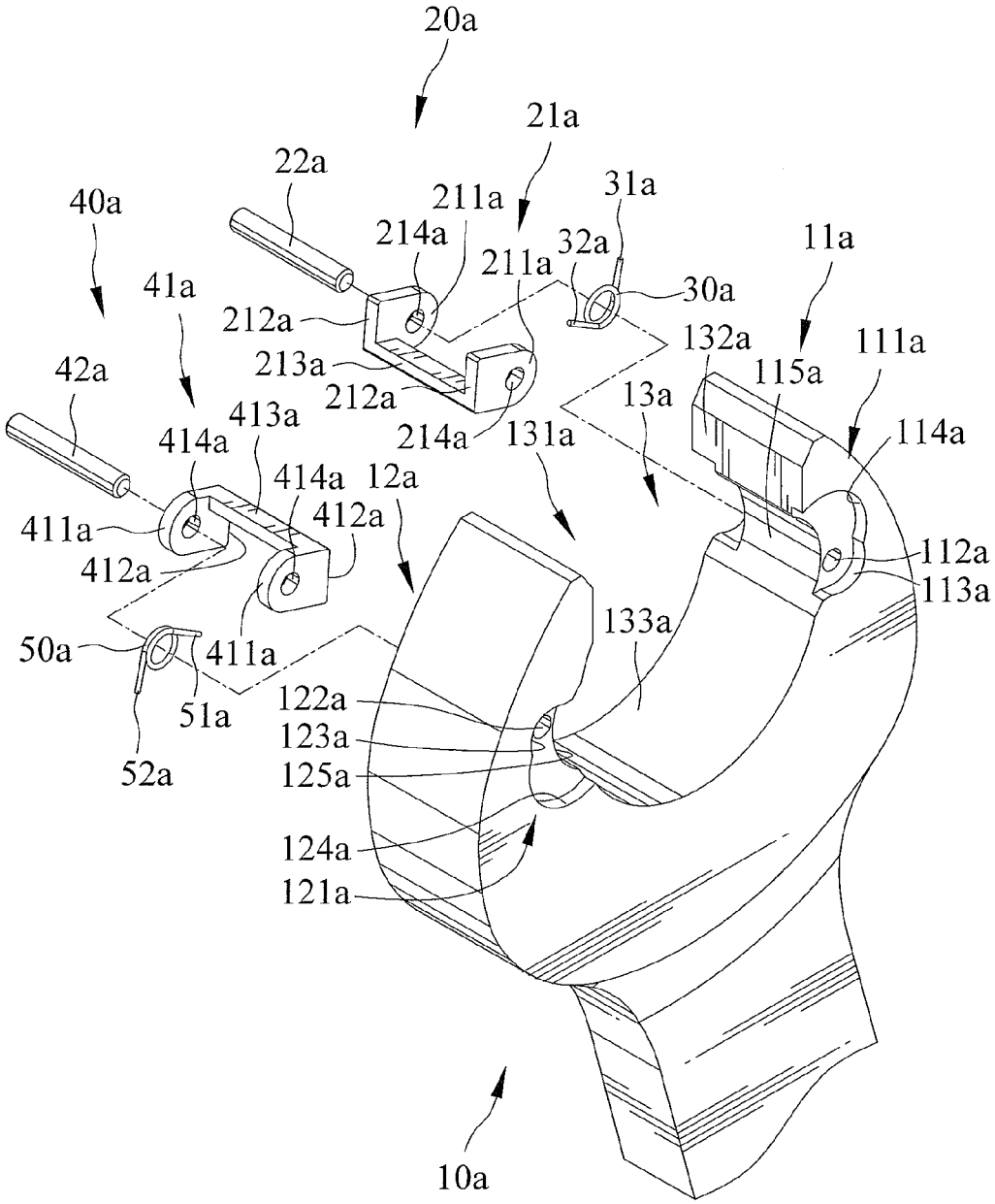
FIG. 16 is another exploded perspective view of the open-end wrench, taken from a view different than that of FIG. 15.
Figure 17:
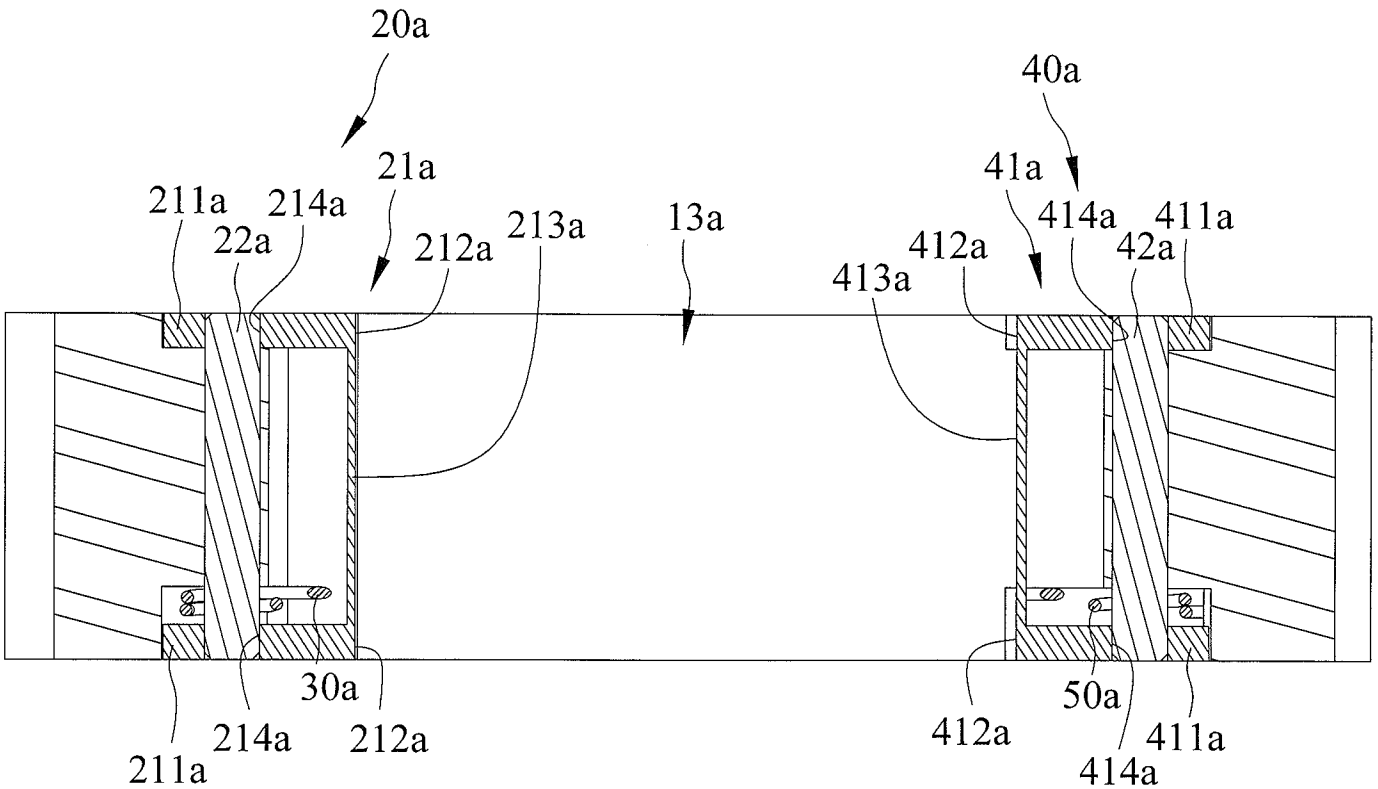
FIG. 17 is a cross-sectional view of the open-end wrench of FIG. 14.
Figure 18:
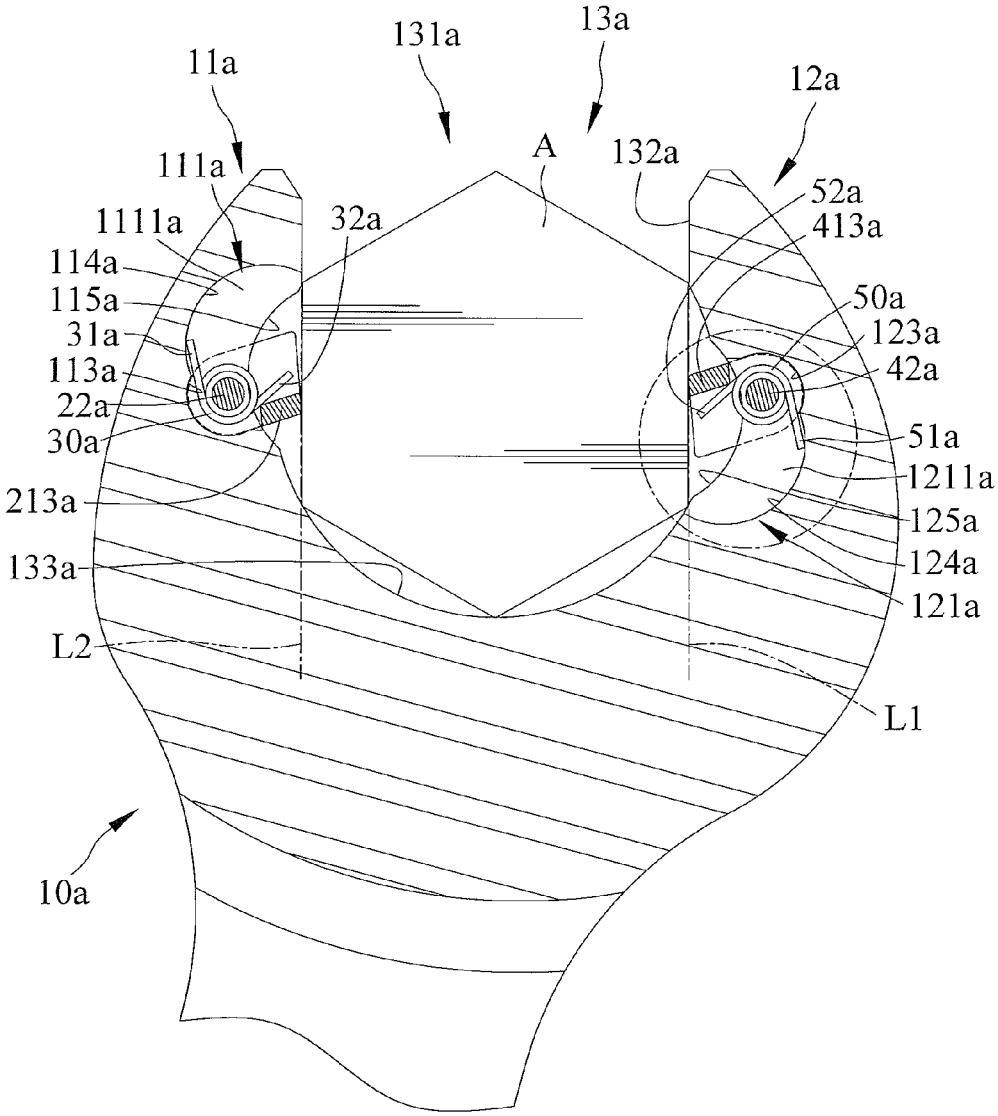
FIG. 18 is another cross-sectional view of the open-end wrench of FIG. 17.
Figure 19:
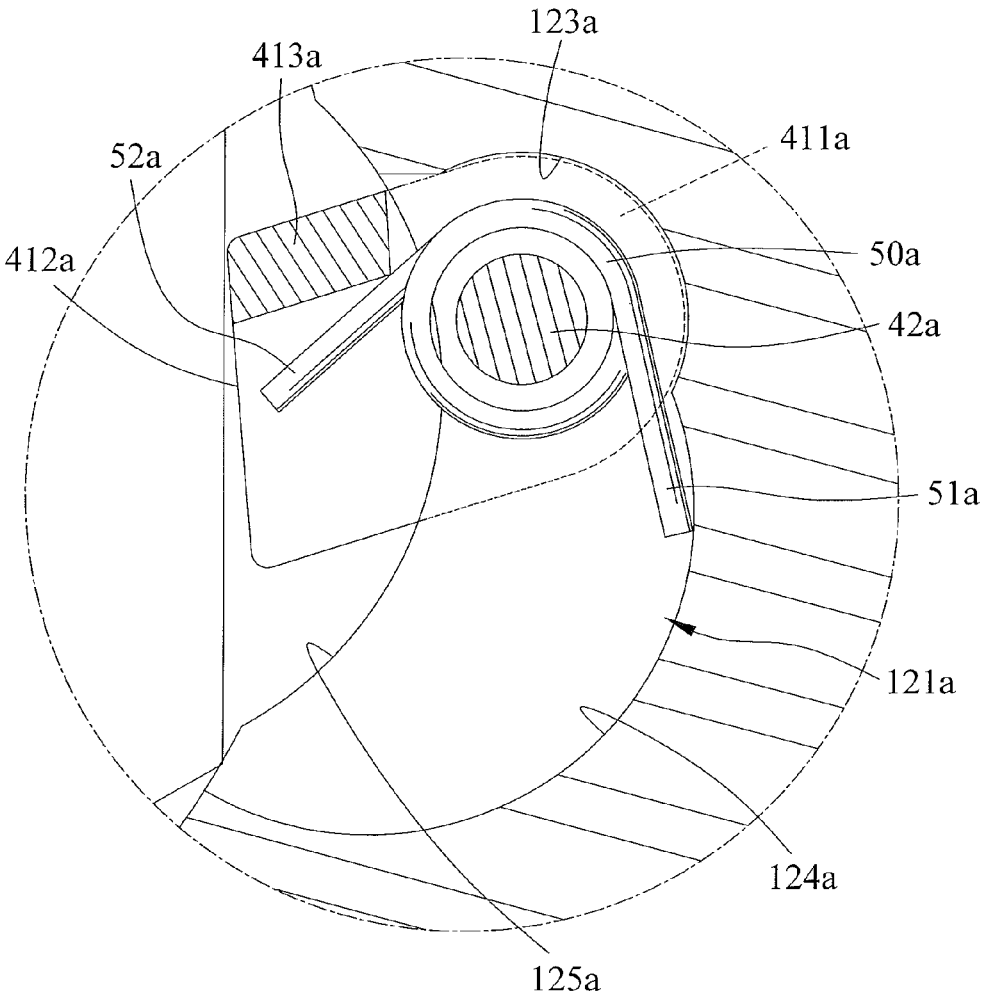
FIG. 19 is a partial, enlarged cross-sectional view of FIG. 18.
Figure 20:
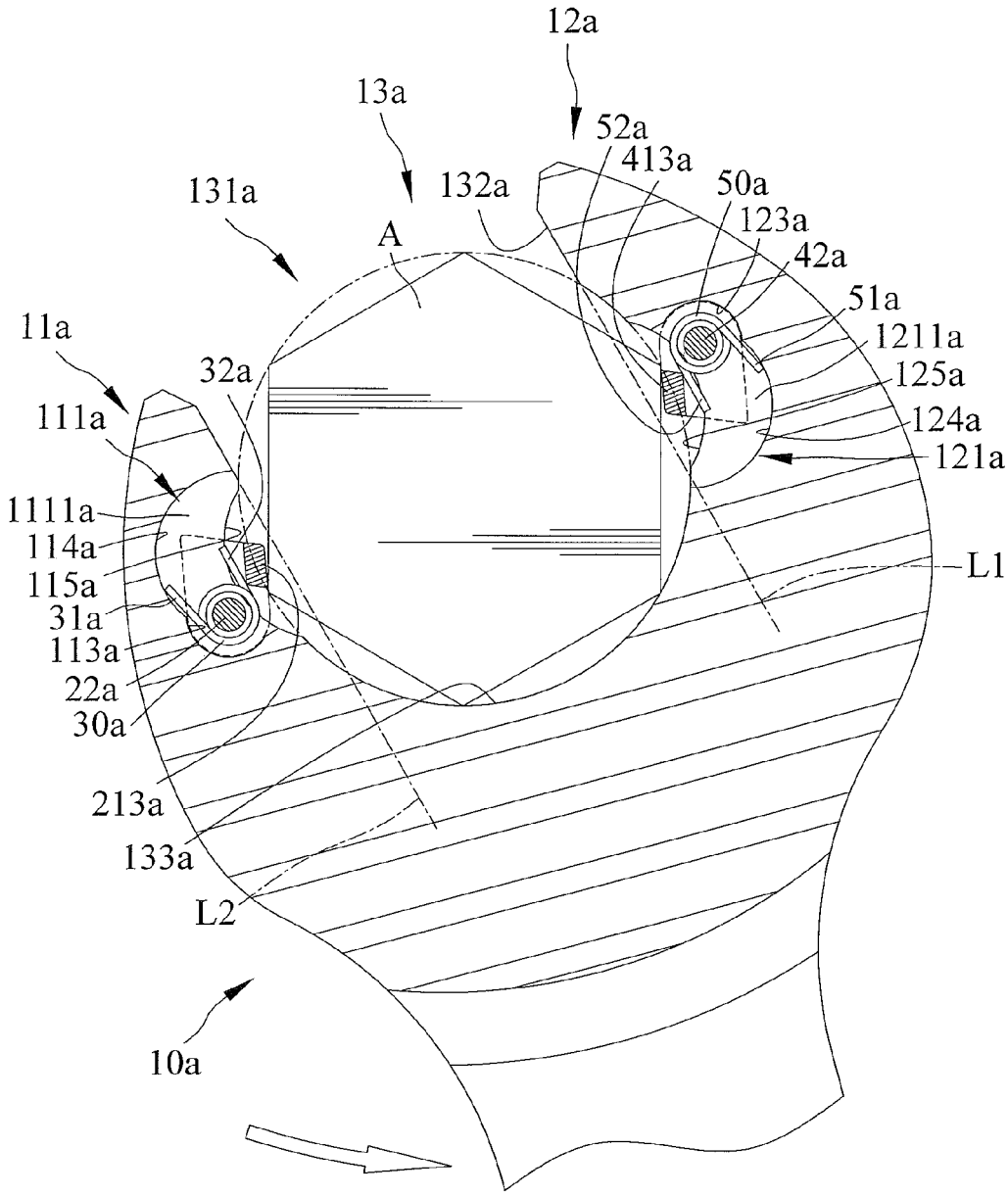
FIG. 20 is an extended cross-sectional view of FIG. 18 showing the open-end wrench turned in a direction where it is turned relatively to the object.
Figure 21:
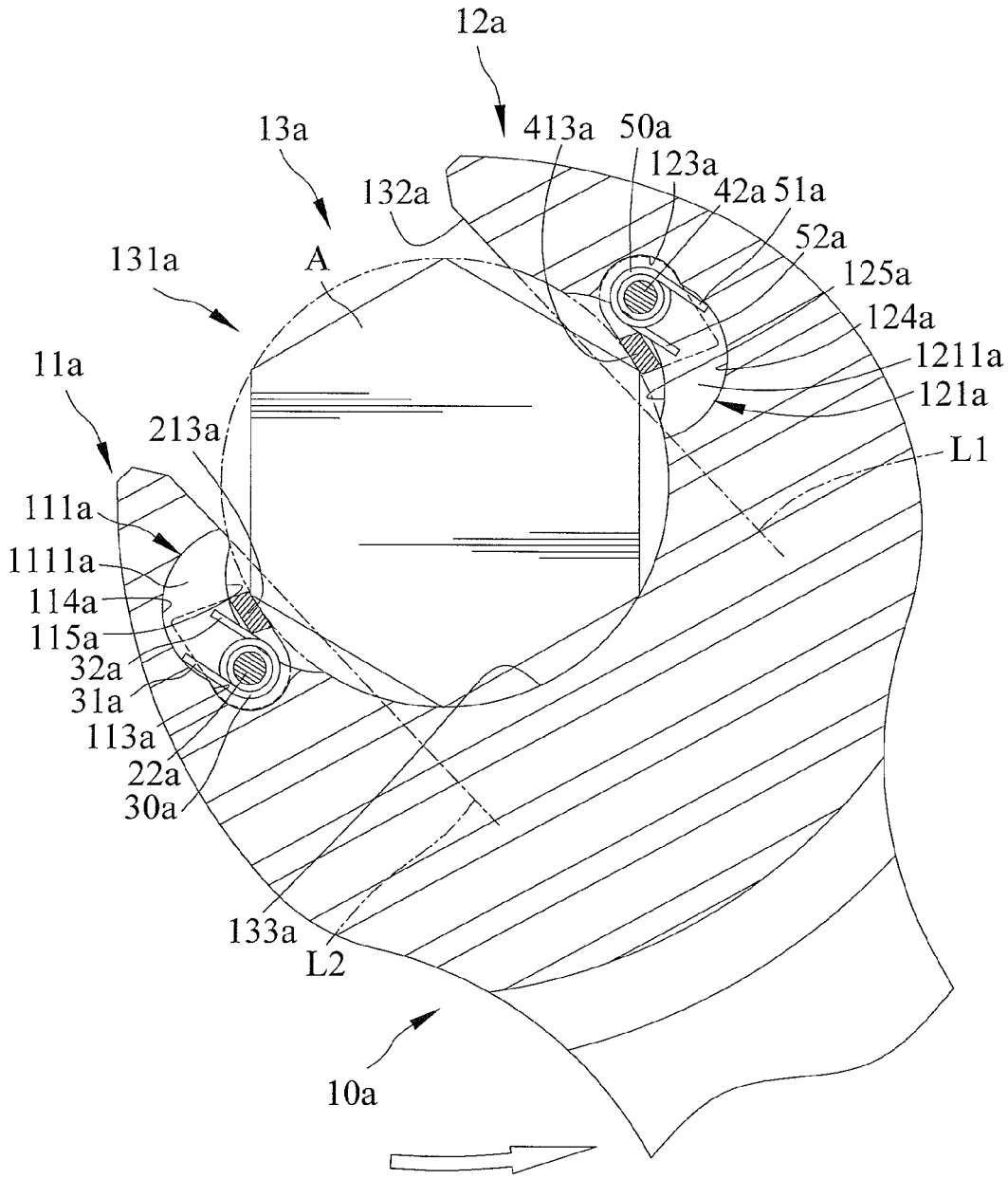
FIG. 21 is continued cross-section view of FIG. 20.
Figure 22:
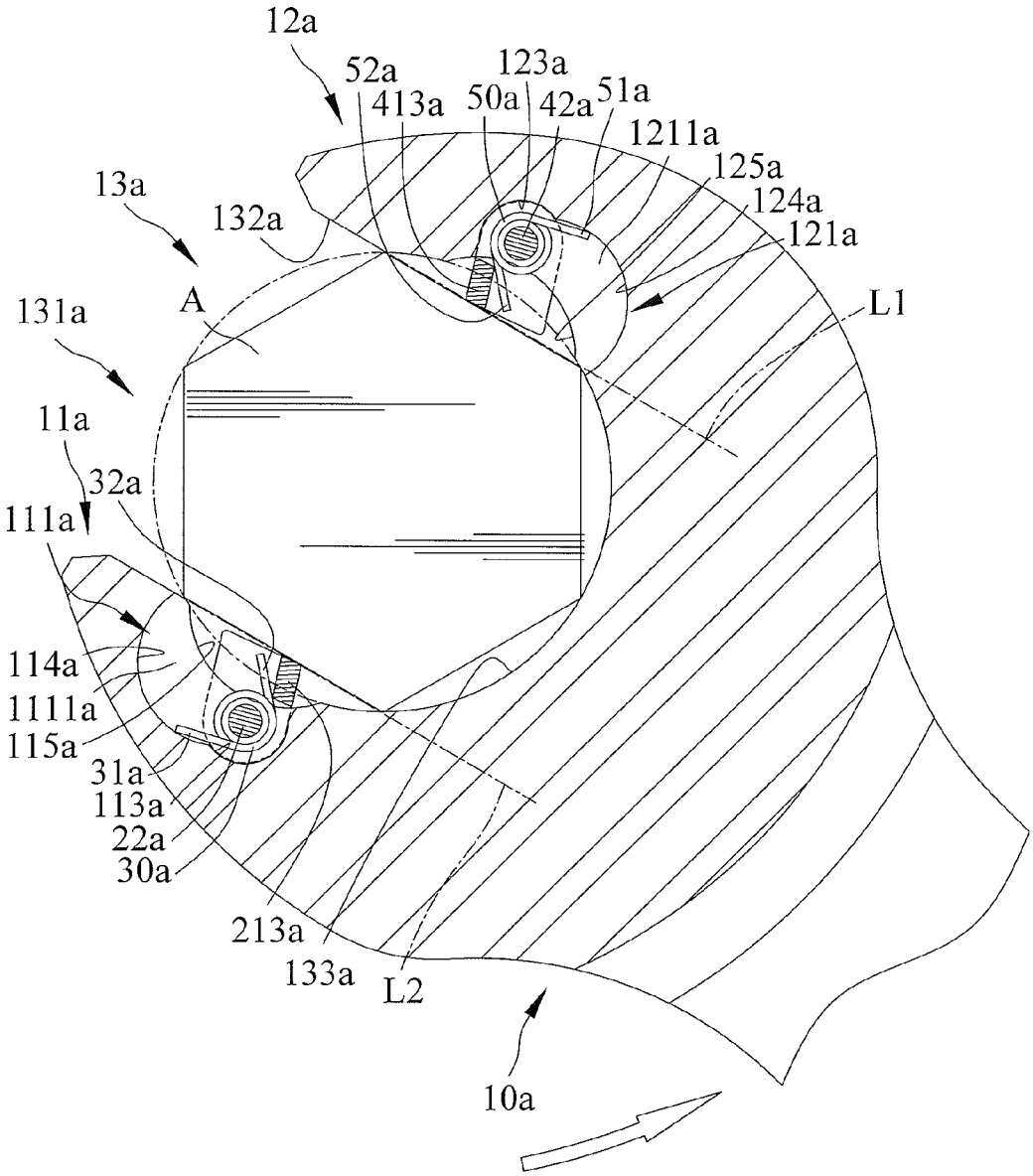
FIG. 22 is continued cross-section view of FIG. 21.
Figure 23:
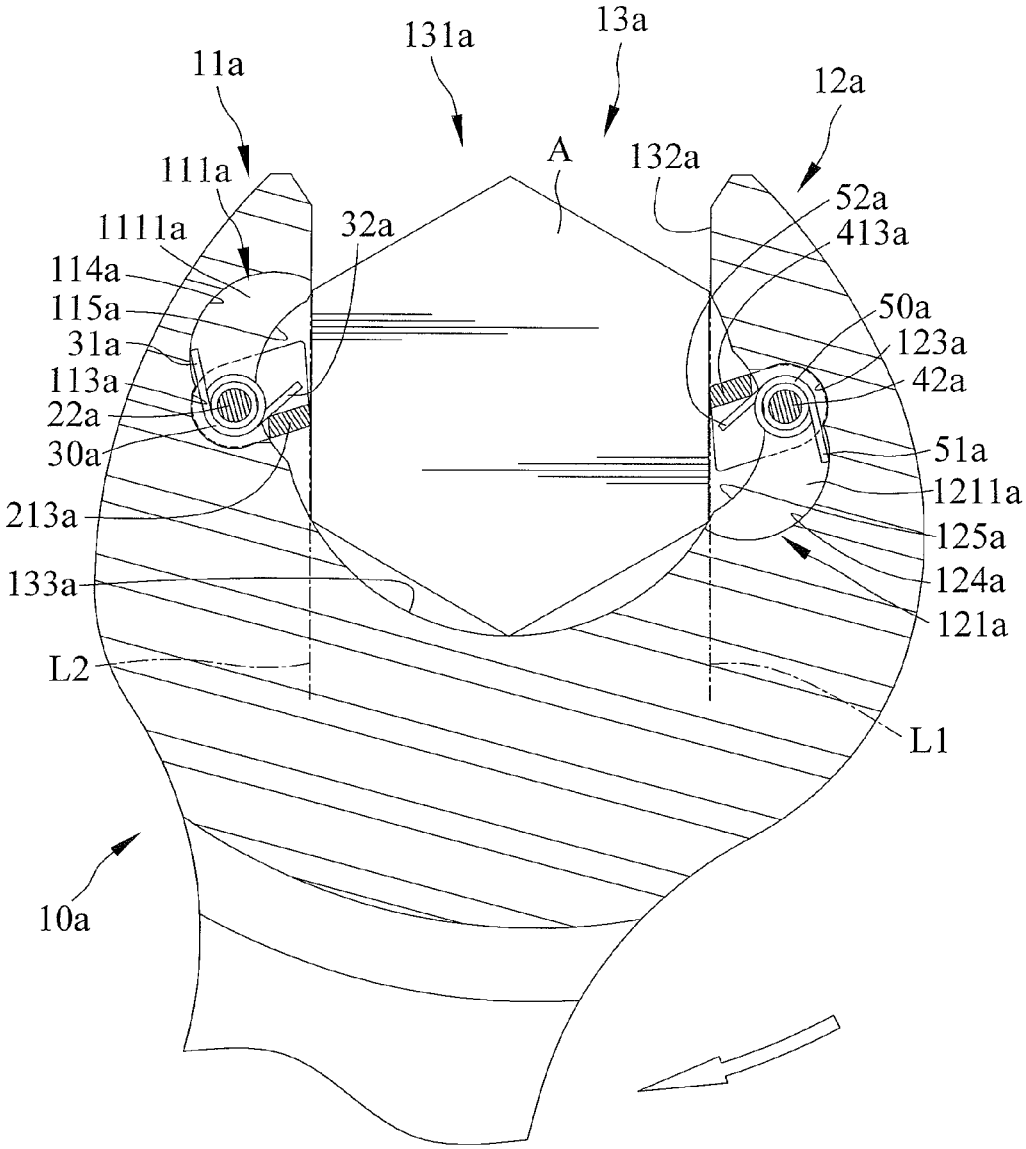
FIG. 23 is a cross-sectional view the showing the open-end wrench turned in a direction whereby the object is turned in the same direction.

FIGS. 1 through 13 show an open-end wrench for quickly turning an object "A" in accordance with a first embodiment of the present invention, because it can be turned in a first turning direction to turn the object "A" and in a second turning direction to move relatively to the object, with the object not turned, to gain a position that allows a better turning position for the user, which was done conventionally by disengaging the wrench with the object and then reengaging it. The open-end wrench includes a driving end 10 including two opposite sides, namely, a first side 101 and a second side 102. The driving end 10 further includes a first jaw 11 and a second jaw 12 which cooperate together to form a space 13 defined therebetween. The first jaw 11 has two opposite lateral sides defined from the first and sides 101 and 102, respectively. The second jaw 12 has two opposite lateral sides defined from the first and second sides 101 and 102, respectively. The space 13 extends from the first side 101 to the second side 102 and includes an open end 131, two first outline sections 132 delimited by the first and second jaws 11 and 12, and a second outline section 133 extending between the first and second jaws 11 and 12 and disposed oppositely to the open end. The two first outline sections 132 are flat. A first straight imaginary line "L1" can be drawn along an edge of the first outline section 132 delimited by the first jaw 11, and a second straight imaginary line "L2" can be drawn along an edge of the first outline section 132 delimited by the second jaw 12. The second outline section 133 is arcuate. The object "A" is received in the space 13 and includes a circumferential surface abutting against the first and second jaws 11 and 12 when object "A" is to be operably turned by the open-end wrench. Furthermore, the first jaw 11 includes a first recess 111 defined therein and having an opening connected to and communicating with the space 13, and the second jaw 12 includes a second recess 121 defined therein and having an opening connected to and communicating with the space 13, respectively. Each of the first and second recesses 111 and 121 extends from a first terminal end to a second terminal end. The first terminal end is not enclosed, and the second terminal end is enclosed. Further, an aperture 112 is defined in a wall of the first recess 111, and an aperture 122 is defined in a wall of the second recess 121, respectively. Furthermore, the first recess 111 includes a lateral wall defining a first surface 113 and a second surface 114 extending from the first surface 113, and the second recess 121 includes a lateral wall defining a first surface 123 and a second surface 124 extending from the first surface 123, respectively. Moreover, the first recess 111 includes the first and second surfaces 113 and 114 opposing to its opening, and the second recess 121 includes the first and second surfaces 123 and 124 opposing to its opening, respectively.

The open-end wrench further includes a first movable engaging member 20 including a first body 21 pivotally fixed in the first recess 111 by a first pivot 22 and in a surface contact with the lateral wall of the first recess 111, and a second movable engaging member 40 including a second body 41 pivotally fixed in the second recess 121 by a second pivot 42 and in a surface contact with the lateral wall of the second recess 121, respectively. The first pivot 22 is inserted in a direction through the first body 21 through an orifice 214 defined therein and fixedly engages with the wall of the first recess 111, i.e. the second terminal end of the first recess 111. The second pivot 42 is inserted in a direction through the second body 41 through an orifice 414 defined therein and fixedly engages with the wall of the second recess 121, i.e. the second terminal end of the second recess 121. Further, a first elastic member 30 resiliently engages with the first movable engaging member 20, and a second elastic member 50 resiliently engages with the second movable engaging member 40, respectively. The first elastic member 30 includes a first leg 31 abutting against the lateral wall of the first recess 111 and a second leg 32 abutting against the first movable engaging member 20. The first elastic member 30 further includes at least one loop. The first leg 31 extends from one of two distal ends of the loop, and the second leg 32 extends from the other of the two distal ends of the loop. The first pivot 22 is inserted through the at least one loop of the first elastic member 30. The second elastic member 50 includes a first leg 51 abutting against the lateral wall of the second recess 121 and a second leg 52 abutting against the second movable engaging member 40. The second elastic member 50 further includes at least one loop. The first leg 51 extends from one of two distal ends of the loop, and the second leg 52 extends from the other of the two distal ends of the loop. The second pivot 42 is inserted through the at least one loop of the second elastic member 50. Additionally, when the open-end wrench is turned in the first turning direction, the first movable engaging member 20 fixedly abuts against the circumferential surface of the object "A" by the lateral wall of the first recess 111, and the second movable engaging member 40 fixedly abuts against the circumferential surface of the object "A" by the lateral wall of the second recess 121, respectively. On the contrary, when the open-end wrench is turned in the second turning direction, the first movable engaging member 20 is activated to pivot in a first pivoting direction by the circumferential surface of the object "A", and in addition, is adapted to be pivoted through a range until it is stopped by the second surface 114 of the lateral wall of the first recess 111, and is activated to pivot in a reverse direction to the first pivoting direction by the first elastic member 30 when the open-end wrench moves from where a side of the circumferential surface of the object "A" urging the first movable engaging member 20 has a first internal diameter with respect to a center of the object "A" to where a side of the circumferential surface of the object "A" urging the first movable engaging member 20 has a second internal diameter smaller than the first internal diameter. In addition, when the open-end wrench is turned in the second turning direction, the second movable engaging member 40 is activated to pivot in a second pivoting direction opposite to the first pivoting direction by the circumferential surface of the object "A", and in addition, is activated to pivot in a reverse direction to the second pivoting direction by the second elastic member 50 when the open-end wrench moves from where a side of the circumferential surface of the object "A" urging the first movable engaging member 20 has a first internal diameter with respect to a center of the object "A" to where a side of the circumferential surface of the object "A" urging the first movable engaging member 20 has a second internal diameter smaller than the first internal diameter. The object "A" is hexagonal and has six apexes adapted to lie on the circumference of an imaginary circle "C".

Furthermore, the first recess 111 bears the first body 21. That is, the first surface 113 of the lateral wall of the first recess 111 pivotally supports the first body 21. Likewise, the second recess 121 bears the second body 41. That is, the first surface 123 of the lateral wall of the second recess 121 pivotally supports the second body 41. Furthermore, the first body 21 includes a first extension 211 pivotally supported and borne by the first surface 113 of the lateral wall of the first recess 111, a second extension 212 extending oppositely from the first extension 211 and fixedly abutting against the circumferential surface of the object "A" when the open-end wrench is turned in the first direction, and a third extension 213 extending from the second extension 212 and engaging with the second leg 32 of the first elastic member 30, which resiliently engages with the first movable engaging member 20. Similarly, the second body 41 includes a first extension 411 pivotally supported and borne by the first surface 123 of the lateral wall of the second recess 121, a second extension 412 extending oppositely from the first extension 411 and fixedly abutting against the circumferential surface of the object "A" when the open-end wrench is turned in the first direction, and a third extension 413 extending from the second extension 412 and engaging with the second leg 52 of the second elastic member 50.

FIGS. 14 through 23 show an open-end wrench in accordance with a second embodiment of the present invention. The second embodiment includes all the elements of the first embodiment and utilizes the same numerals, except bearing a suffix "a". The second embodiment differentiates from the first embodiment in that a first movable engaging member 20*a* includes a first body 21*a* including two first extensions 211*a*, two second extensions 212*a*, and a third extension 213*a*, and a second movable engaging member 40*a* includes a second body 41*a* including two first extensions 411*a*, two second extensions 412*a*, and a third extension 413*a*. The two first extensions 211*a* of the first body 21*a* are disposed in a spaced relationship and are pivotally supported and borne by a first surface 113*a* of a lateral wall of the first recess 111*a*. The two first extensions 411*a* of the second body 41*a* are disposed in a spaced relationship and are pivotally supported and borne by a first surface 123*a* of a lateral wall of a second recess 121*a*. The two second extensions 212*a* and 412*a* of each of the first and second bodies 21*a* and 41*a* extend oppositely from the two first extensions 211*a* and 411*a* respectively and fixedly abutts against the circumferential surface of the object "A" when the open-end wrench is turned in the first direction. The third extension 213*a*, 413*a* of each of the first and second bodies 21*a* and 41*a* extend between the two first extensions 211*a* and 411*a* as well as the two second extensions 212*a* and 412*a*. Further, a first elastic member 30*a* includes a first leg 31*a* and a second leg 32*a*. Likewise, the first leg 31*a* abuts against a lateral wall of the first recess 111*a*. The third extension 213*a* engages with the second leg 32*a*. The second leg 32*a* is disposed between the two first extensions 211*a* as well as the two second extensions 212*a* of the first body 21*a*. Further, a second elastic member 50*a* includes a first leg 51*a* and a second leg 52*a*. Likewise, the first leg 51*a* abuts against a lateral wall of the second recess 121*a*. The second leg 52*a* is disposed between the two first extensions 411*a* as well as the two second extensions 412*a* of the second body 41*a*.

Furthermore, each of the first and second recesses 111*a* and 121*a* extends from a first terminal end to a second terminal end. The first and second terminal ends are not enclosed. Further, a protrusion 115*a* and a protrusion 125*a* are disposed between the first and second terminal ends and include two opposite sides 1111*a*. Additionally, the first body 21*a* includes one of the two first extensions 211*a* as well as one of the two second extensions 212*a* disposed adjacent to one of the two sides 1111*a* of the protrusion 115*a* in the first recess 111*a*, and the other of the two first extensions 211*a* as well as the other of the two second extensions 212*a* disposed adjacent to the other of the two sides 1111*a* of the protrusion 115*a* in the first recess 111*a*. Likewise, the second body 41*a* includes one of the two first extensions 411*a* as well as one of the two second extensions 412*a* disposed adjacent to one of the two sides 1211*a* of the protrusion 125*a* in the second recess 121*a*, and the other of the two first extensions 411*a* as well as the other of the two second extensions 412*a* disposed adjacent to the other of the two sides 1211*a* of the protrusion 125*a* in the second recess 121*a*.

Figure 24:
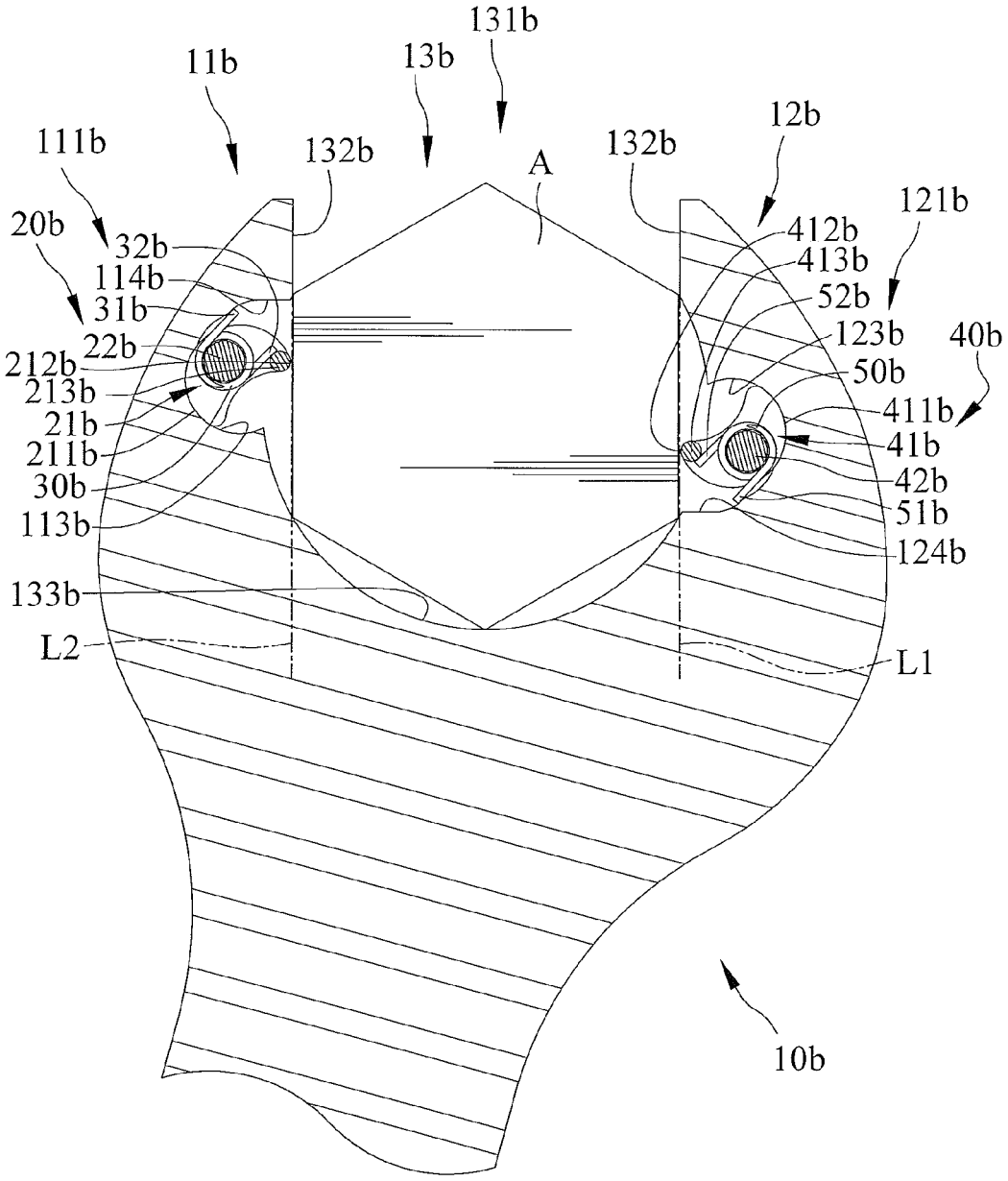
FIG. 24 is a cross-section view of an open-end wrench for quickly turning an object in accordance with a third embodiment of the present invention.

FIG. 24 shows an open-end wrench in accordance with a third embodiment of the present invention. The third embodiment includes all the elements of the first embodiment and utilizes the same numerals, except bearing a suffix "b". The third embodiment differentiates from the first embodiment in that a first movable engaging member 20*b* includes a first body 21*b* of a peripheral shape including a first arcuate peripheral surface with two distal ends and a second arcuate peripheral surface extending from one terminal end to the other terminal end of the first arcuate peripheral surface, and a second movable engaging member 40*b* includes a second body 41*b* of a peripheral shape including a first arcuate peripheral surface with two distal ends and a second arcuate peripheral surface extending from one terminal end to the other terminal end of the first arcuate peripheral surface.

Figure 25:
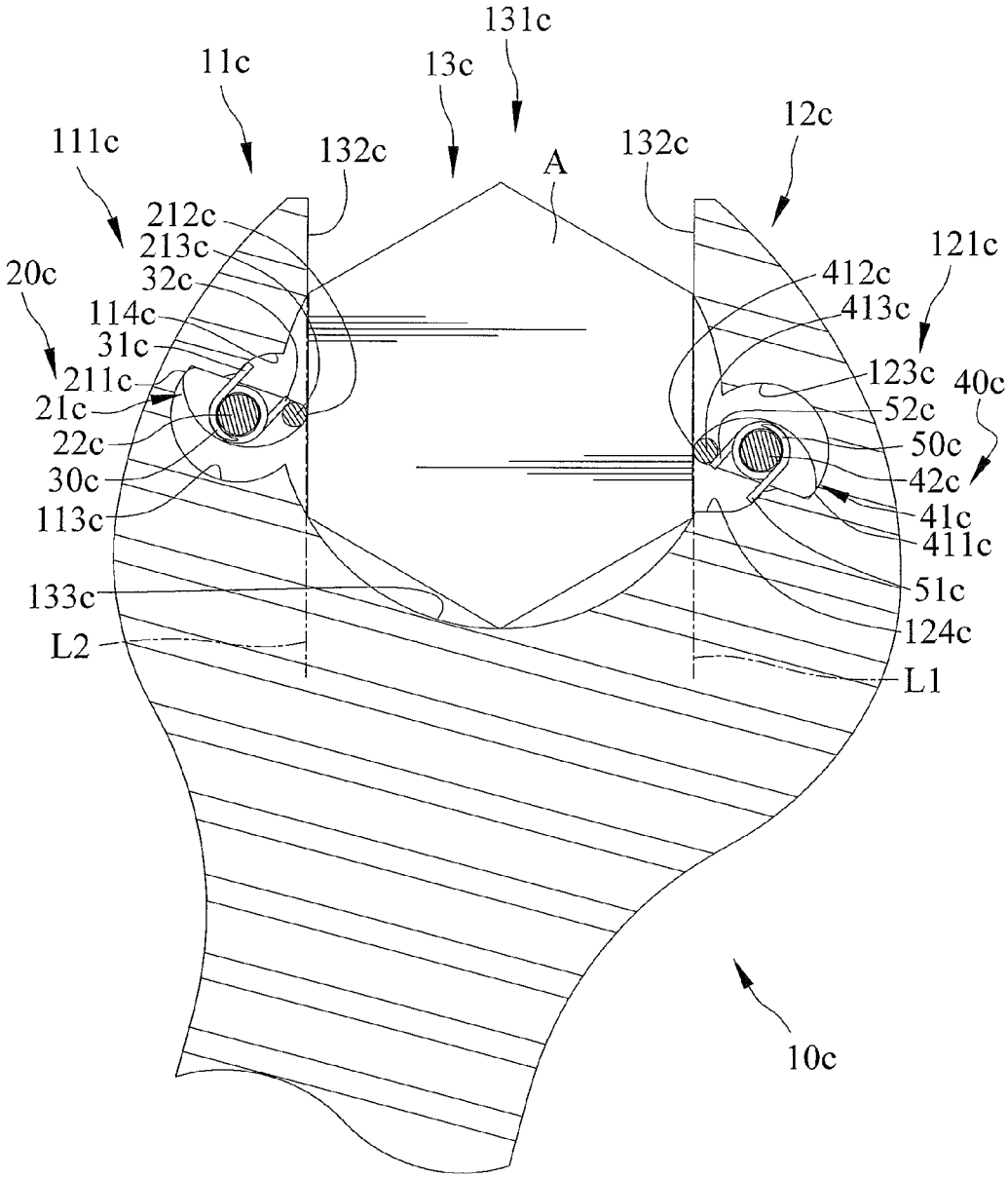
FIG. 25 is a cross-section view of an open-end wrench for quickly turning an object in accordance with a fourth embodiment of the present invention.

FIG. 25 shows an open-end wrench in accordance with a fourth embodiment of the present invention. The fourth embodiment includes all the elements of the first embodiment and utilizes the same numerals, except bearing a suffix "c". The fourth embodiment differentiates from the first embodiment in that a first movable engaging member 20*c* includes a first body 21*c* of a peripheral shape including an arcuate peripheral surface with two distal ends and a straight peripheral surface extending from one terminal end to the other terminal end of the arcuate peripheral surface, and a second movable engaging member 40*c* includes a second body 41*c* of a peripheral shape including a arcuate peripheral surface with two distal ends and a straight peripheral surface extending from one terminal end to the other terminal end of the arcuate peripheral surface.

Although not shown, it is adapted that the open-end wrench is capable of quickly turning the object "A" without the second movable engaging member 40, 40*a*, 40*b*, 40*c* and the related elements.

In view of the forgoing, each movable engaging member 20, 20*a*; 20*b*, 20*c*, 40, 40*a*, 40*b*, and 40*c* includes the body 21, 21*a*, 21*b*, 21*e*, 41, 41*a*, 41*b*, and 41*c* in a surface contact with a lateral wall of the recess 111, 111*a*, 111*b*, 111*c*, 121, 121*a*, 121*b*, and 121*c*, respectively. Therefore, each movable engaging member 20, 20*a*; 20*b*, 20*c*, 40, 40*a*, 40*b*, and 40*c* is prevented to suffer a stress concentration and is capable of withstanding a large torque force when being utilized to abut against the object "A" during the operation of turning the object "A".

While the specific embodiments have been illustrated and described, numerous modifications come to mind without significantly departing from the spirit of invention, and the scope of invention is only limited by the scope of the accompanying claims.

What is claimed is:

1. An open-end wrench for quickly turning an object comprising:

a driving end including a first jaw and a second jaw cooperating together to form a space defined therebetween, wherein the object is received in the space and includes a circumferential surface abutting against the first and second laws when operably turned by the open-end wrench, with one of the first and second jaws including a first recess defined therein and having an opening connected to and communicating with the space, with the first recess having a lateral wall including a first arcuate surface having first and second distal ends;

a first movable engaging member including a first body pivotally fixed in the first recess by a first pivot, with the first body having an arcuate peripheral surface, with the first arcuate surface and the arcuate peripheral surface centered about the first pivot, with the arcuate peripheral surface of the first body in surface contact with the first arcuate surface of the lateral wall of the first recess, with the first recess pivotally supporting the first body during pivoting of the first body relative to the first recess, with the first pivot inserted in a direction through the body and fixedly engaged with a wall of the first recess; and a first elastic member resiliently engaging with the first movable engaging member and including a first leg abutting against the first distal end of the first arcuate surface of the lateral wall of the first recess and a second leg abutting against the first movable engaging member, with the first elastic member biasing the first movable engaging member to engage with the second distal end of the first arcuate surface of the first recess;

wherein the first elastic member includes a loop, with the first leg extending from one of two distal ends of the loop, with the second leg extending from another of the two distal ends of the loop, with the first pivot inserted through the loop;

wherein the open-end wrench is turned in a first turning direction to turn the object, with the first movable engaging member fixedly abutting against the circumferential surface of the object by the lateral wall of the first recess; and wherein the open-end wrench is turned in a second turning direction to move relatively to the object, with the object not turned, with the first movable engaging member being activated to pivot in a first pivoting direction by the circumferential surface of the object, with the first movable engaging member being activated to pivot in a reverse direction to the first pivoting direction by the first elastic member.

2. The open-end wrench as claimed in claim 1, wherein the other of the first and second jaws includes a second recess defined therein and having an opening connected to and communicating with the space, wherein the open-end wrench further comprises: a second movable engaging member including a second body pivotally fixed in the second recess by a second pivot, with the second body in surface contact with a lateral wall of the second recess, with the second recess pivotally supporting the second body during pivoting of the second body relative to the second recess, with the second pivot inserted in a direction through the body and fixedly engaged with a wall of the second recess, with the second movable engaging member also including a second elastic member resiliently engaging with the second movable engaging member and including a first leg abutting against the lateral wall of the second recess and a second leg abutting against the second movable engaging member, wherein when the open-end wrench is turned in the first turning direction, the second movable engaging member fixedly abuts against the circumferential surface of the object by the lateral wall of the second recess, and wherein when the open-end wrench is turned in the second turning direction, the second movable engaging member is activated to pivot in a second pivoting direction opposite to the first pivoting direction, with the second movable engaging member being activated to pivot in a reverse direction to the second pivoting direction by the second elastic member.

3. The open-end wrench as claimed in claim 2, wherein the second elastic member includes a loop, with the first leg of the second elastic member extending from one of two distal ends of the loop of the second elastic member, with the second leg of the second elastic member extending from another of the two distal ends of the loop of the second elastic member, with the second pivot inserted through the loop of the second elastic member.

4. The open-end wrench as claimed in claim 2, wherein each of the first and second recesses extends from a first terminal end to a second terminal end, with the first terminal end of the first recess not enclosed, with the first terminal end of the second recess not enclosed, with the first and second movable engaging members inserted in the first and second recesses respectively through the related first terminal ends, with the second terminal end of the first recess enclosed by the wall receiving the first pivot, with the second terminal end of the second recess enclosed by the wall receiving the second pivot.

5. The open-end wrench as claimed in claim 2, wherein each of the first and second bodies includes a first extension, a second extension, and a third extension, with the first extension of the first body pivotally supported and borne by the first arcuate surface of the lateral wall of the first recess, with the first extension of the second body pivotally supported and borne by a first surface of the lateral wall of the second recess, with the second extension of each of the first and second bodies extending oppositely from the first extension and fixedly abutting against the circumferential surface of the object when the open-end wrench is turned in the first direction, with the third extension of each of the first and second bodies extending from the second extension, with the third extension of the first body engaging with the second leg of the first elastic member, with the third extension of the second body engaging with the second leg of the second elastic member.

6. The open-end wrench as claimed in claim 2, wherein each of the first body and second bodies includes two first extensions, two second extensions, and a third extension, with the two first extensions of the first body disposed in a spaced relationship and pivotally supported and borne by the first arcuate surface of the lateral wall of the first recess, with the two first extensions of the second body disposed in a spaced relationship and pivotally supported and borne by a first surface of the lateral wall of the second recess, with the two second extensions of each of the first and second bodies extending oppositely from the two first extensions respectively and fixedly abutting against the circumferential surface of the object when the open-end wrench is turned in the first direction, with the third extension of each of the first and second bodies extending between the two first extensions as well as the two second extensions, with the third extension of the first body engaging with the second leg of the first elastic member, and the second leg of the first elastic member disposed between the two first extensions as well as the two second extensions of the first body, with the third extension of the second body engaging with the second leg of the second elastic member, with the second leg of the second elastic member disposed between the two first extensions as well as the two second extensions of the second body.

7. The open-end wrench as claimed in claim 6, wherein each of the first and second recesses extends from a first terminal end to a second terminal end, with the first and second terminal ends not enclosed, with a protrusion disposed between the first and second terminal ends and including two opposite sides, with the first body of the first movable engaging member including one of the two first extensions as well as one of the two second extensions disposed adjacent to one of the two opposite sides of the protrusion in the first recess, with another of the two first extensions as well as another of the two second extensions disposed adjacent to another of the two opposite sides of the protrusion in the first recess, with the second body of the second movable engaging member including one of the two first extensions as well as one of the two second extensions disposed adjacent to one of the two opposite sides of the protrusion in the second recess, and with another of the two first extensions as well as another of the two second extensions disposed adjacent to another of the two opposite sides of the protrusion in the second recess.

8. The open-end wrench as claimed in claim 2, wherein the first movable engaging member includes the first body including the arcuate peripheral surface with two distal ends and a straight peripheral surface extending from one distal end to another distal end of the arcuate peripheral surface.

9. The open-end wrench as claimed in claim 1, wherein the first recess extends from a first terminal end to a second terminal end, with the first terminal end not enclosed, with the first movable engaging member inserted in the first recess through the first terminal end, with the second terminal end enclosed by the wall receiving the first pivot.

10. The open-end wrench as claimed in claim 1, wherein the first body of the first movable engaging member includes a first extension pivotally supported and borne by the first arcuate surface of the lateral wall of the first recess, a second extension extending oppositely from the first extension and fixedly abutting against the circumferential surface of the object when the open-end wrench is turned in the first direction, and a third extension extending from the second extension and engaging with the second leg of the first elastic member.

11. The open-end wrench as claimed in claim 1, wherein the first body of the first movable engaging member includes two first extensions disposed in a spaced relationship and pivotally supported and borne by the first arcuate surface of the lateral wall of the first recess, two second extensions extending oppositely from the two first extensions respectively and fixedly abutting against the circumferential surface of the object when the open-end wrench is turned in the first direction, and a third extension extending between the two first extensions as well as the two second extensions and engaging with the second leg of the first elastic member, with the second leg disposed between the two first extensions as well as the two second extensions.

12. The open-end wrench as claimed in claim 11, wherein the first recess extends from a first terminal end to a second terminal end, with the first and second terminal ends not enclosed, with a protrusion disposed between the first and second terminal ends and including two opposite sides, with the first body of the first movable engaging member including one of the two first extensions as well as one of the two second extensions disposed adjacent to one of the two opposite sides of the protrusion in the first recess, and with another of the two first extensions as well as another of the two second extensions disposed adjacent to another of the two opposite sides of the protrusion in the first recess.

13. An open-end wrench for quickly turning an object comprising:

a driving end including a first jaw and a second jaw cooperating together to form a space defined therebetween, wherein the object is received in the space and includes a circumferential surface abutting against the first and second laws when operably turned by the open-end wrench, with the first jaw including a first recess defined therein and having an opening connected to and communicating with the space, wherein the second jaw includes a second recess defined therein and having an opening connected to and communicating with the space;

a first movable engaging member;

a second movable engaging member, wherein each of the first and second movable engaging members includes a first body of a peripheral shape including a first arcuate peripheral surface with two distal ends and a second arcuate peripheral surface extending from one terminal end to the other terminal end of the first arcuate peripheral surface, with the first body of the first movable engaging member pivotally fixed in the first recess by a first pivot, with the first body of the first movable engaging member in surface contact with the lateral wall of the first recess, with the first recess supporting the first body of the first movable engaging member, with the first pivot inserted in a direction through the first body and fixedly engaged with a wall of the first recess, with the first body of the second movable engaging member pivotally fixed in the second recess by a second pivot, with the first body of the second movable engaging member in surface contact with a lateral wall of the second recess, with the second recess supporting the first body of the second movable engaging member, with the second pivot inserted in a direction through the first body of the second movable engaging member and fixedly engaged with a wall of the second recess;

a first elastic member resiliently engaging with the first movable engaging member and including a first leg abutting against the lateral wall of the first recess and a second leg abutting against the first movable engaging member;

a second elastic member resiliently engaging with the second movable engaging member and including a first leg abutting against the lateral wall of the second recess and a second leg abutting against the second movable engaging member, wherein the open-end wrench is turned in a first turning direction to turn the object, with the first movable engaging member fixedly abutting against the circumferential surface of the object by the lateral wall of the first recess and the second movable engaging member fixedly abutting against the circumferential surface of the object by the lateral wall of the second recess; and wherein the open-end wrench is turned in a second turning direction to move relatively to the object, with the object not turned, with the first movable engaging member being activated to pivot in a first pivoting direction by the circumferential surface of the object, with the first movable engaging member being activated to pivot in a reverse direction to the first pivoting direction by the first elastic member, the second movable engaging member activated to pivot in a second pivoting direction opposite to the first pivoting direction, and the second movable engaging member activated to pivot in a reverse direction to the second pivoting direction by the second elastic member.

* * * * *